US011312140B2

(12) United States Patent
Arakane

(10) Patent No.: US 11,312,140 B2
(45) Date of Patent: Apr. 26, 2022

(54) LIQUID EJECTION APPARATUS

(71) Applicant: Brother Kogyo Kabushiki Kaisha, Nagoya (JP)

(72) Inventor: Satoru Arakane, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/830,929

(22) Filed: Mar. 26, 2020

(65) Prior Publication Data

US 2020/0307223 A1 Oct. 1, 2020

(30) Foreign Application Priority Data

Mar. 26, 2019 (JP) ..... JP2019-057651

(51) Int. Cl.
*B41J 2/165* (2006.01)
*B41J 2/045* (2006.01)
*B41J 2/21* (2006.01)

(52) U.S. Cl.
CPC ..... *B41J 2/16579* (2013.01); *B41J 2/04501* (2013.01); *B41J 2/2139* (2013.01)

(58) Field of Classification Search
CPC ..... B41J 2/16579; B41J 2/2139; B41J 2/21; B41J 2/04501
See application file for complete search history.

(56) References Cited

U.S. PATENT DOCUMENTS

2003/0142158 A1* 7/2003 Lee ..... B41J 2/04586 347/12
2007/0139461 A1 6/2007 Izuo
2009/0015616 A1* 1/2009 Miyamoto ..... B41J 2/2139 347/14
2011/0115841 A1* 5/2011 Ito ..... B41J 2/04563 347/14
2014/0300657 A1 10/2014 Ike
2016/0107438 A1* 4/2016 Gracia Verdugo ... B41J 2/04586 347/9

FOREIGN PATENT DOCUMENTS

JP 4929699 B2 5/2012
JP 2013-103464 A 5/2013
JP 6231759 B2 11/2017

* cited by examiner

*Primary Examiner* — Justin Seo
(74) *Attorney, Agent, or Firm* — Banner & Witcoff, Ltd.

(57) ABSTRACT

There is provided a liquid ejection apparatus including: a liquid ejection head that includes nozzles; a signal output circuit that outputs a signal that varies depending on whether at least part of the nozzles includes a discharge-defective nozzle; and a controller. The controller is configured to discharge a liquid on a medium by using a partial discharge mode; perform determination, for at least one nozzle included in the nozzles based on the signal from the signal output circuit, about whether the discharge-defective nozzle is included therein; and set, based on the signal from the signal output circuit, the part of the nozzles not to include the discharge-defective nozzle when the liquid is discharged from the liquid ejection head on the medium by using the partial discharge mode and when the controller has determined that the discharge-defective nozzle is included in the nozzles.

12 Claims, 13 Drawing Sheets

LIQUID EJECTION APPARATUS

CROSS REFERENCE TO RELATED APPLICATION

The present application claims priority from Japanese Patent Application No. 2019-057651 filed on Mar. 26, 2019, the disclosure of which is incorporated herein by reference in its entirety.

BACKGROUND

Field of the Invention

The present disclosure relates to a liquid ejection apparatus configured to discharge a liquid from nozzles.

Description of the Related Art

As an exemplary liquid ejection apparatus that discharges a liquid from nozzles, there is publicly known a printer that performs printing by discharging ink from nozzles. In such a printer, heads are arranged in a row direction. Printing is performed on a sheet by discharging ink from nozzles of the heads while conveying the sheet in a conveyance direction orthogonal to the row direction. In a publicly known printer, a head(s) to be used for printing is/are selected from among heads depending on a width of a sheet (a length in a row direction), and the remaining head(s) not used for the printing is/are set as a non-use head(s). Nozzle inspection is performed for all the heads. When the head(s) to be used for printing include(s) a discharge-defective nozzle(s) by which printing is not performed properly, cleaning is performed for the nozzle(s) to be used for printing to solve that problem. When the non-use head(s) include(s) the discharge-defective nozzle(s), cleaning is not performed immediately and printing is continued.

SUMMARY

In the publicly known printer, the head(s) to be used for printing and the non-use head(s) are determined depending on the sheet width. When the head(s) to be used for printing include(s) the discharge-defective nozzle(s), printing is typically performed after cleaning. This lengthens a time after a printing instruction is input until recording is completed.

An object of the present disclosure is to provide a liquid ejection apparatus that makes a time after an instruction for instructing the apparatus to discharge a liquid on a medium is input until the discharge of liquid onto the medium is completed as short as possible.

According to an aspect of the present disclosure, there is provided a liquid ejection apparatus configured to discharge a liquid on a medium, the apparatus including: a liquid ejection head including a plurality of nozzles arranged in a predefined direction; a signal output circuit configured to output a signal that varies depending on whether at least part of the plurality of nozzles includes an discharge-defective nozzle of which discharge performance is lower than a predefined discharge performance; and a controller. The controller is configured to: control the liquid ejection head to discharge the liquid on the medium by using a partial discharge mode in which the liquid is discharged from part of the plurality of nozzles; perform determination, for at least one nozzle included in the plurality of nozzles based on the signal from the signal output circuit, as to whether the discharge-defective nozzle is included therein; set, based on the signal from the signal output circuit, the part of the plurality of nozzles not to include the discharge-defective nozzle in a case that the liquid is discharged from the liquid ejection head on the medium by using the partial discharge mode and that the controller has determined that the discharge-defective nozzle is included in the plurality of nozzles.

In the present disclosure, the controller performs the determination, for at least one nozzle included in the nozzles, about whether the discharge-defective nozzle is included therein. When the liquid is discharged on the medium using the partial discharge mode and when the controller has determined that the discharge-defective nozzle is included, the controller sets part of the nozzles from which the liquid is discharged, not to include the discharge-defective nozzle. In that configuration, even when the controller has determined that the discharge-defective nozzle is included in the nozzles, the controller can set the part of the nozzles not to include the discharge-defective nozzle. The liquid can thus land on the medium appropriately without a discharge operation for the discharge-defective nozzle. Further, it is possible to shorten a time after an instruction for instructing the apparatus to discharge the liquid on the medium is input until the discharge of the liquid on the medium is completed.

DESCRIPTION OF THE EMBODIMENTS

Configuration of Printer 1

Figure 1:
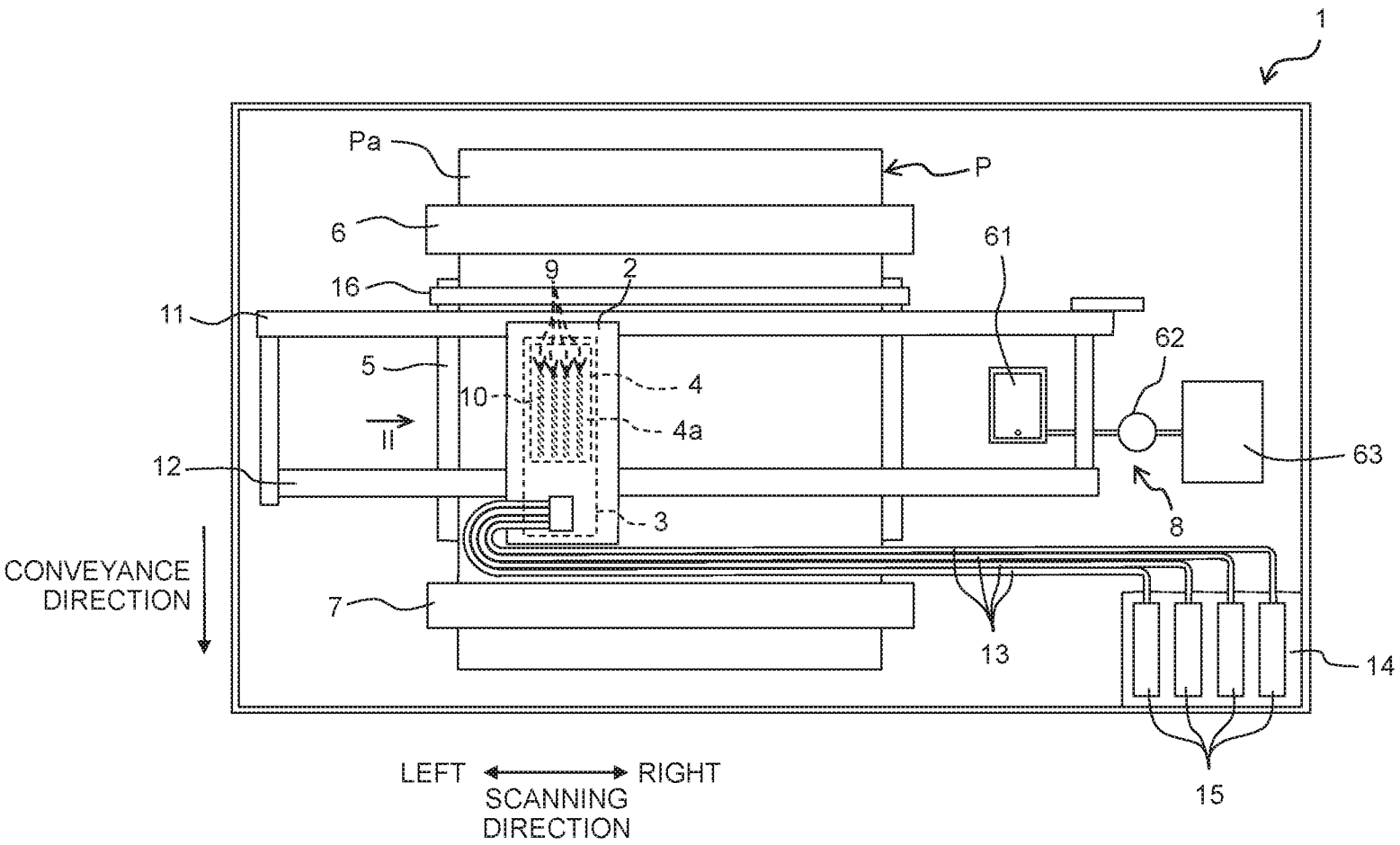
FIG. 1 schematically depicts a configuration of a printer 1.
Figure 2:
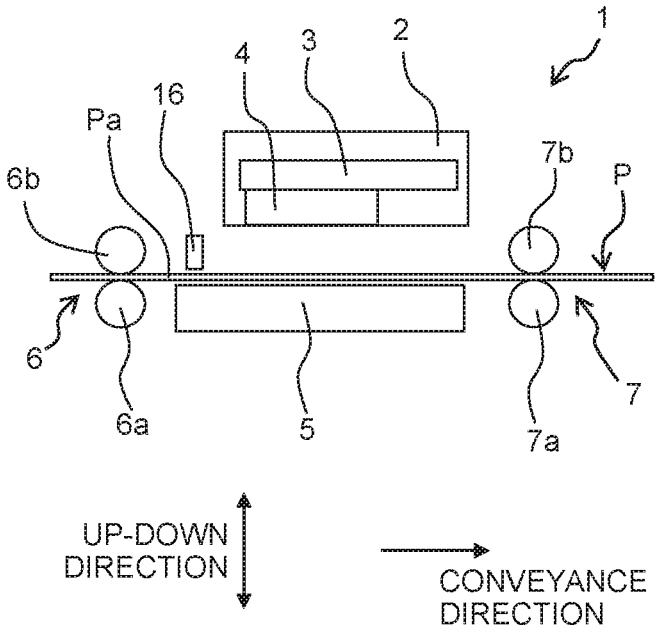
FIG. 2 depicts a positional relationship between a carriage 2, a subtank 3, an ink-jet head 4, a platen 5, conveyance roller pairs 6, and a holding member 16 when seen from a direction of an arrow II in FIG. 1.

As depicted in FIGS. 1 and 2, a printer 1 (a liquid ejection apparatus of the present disclosure) according this embodiment includes a carriage 2, a subtank 3, an ink-jet head 4 (a liquid ejection head of the present disclosure), a platen 5, and conveyance roller pairs 6 and 7 (a conveyer of the present disclosure), a maintenance unit 8, and the like.

The carriage 2 is supported by two guide rails 11 and 12 extending in a scanning direction. The carriage 2 is connected to a carriage motor 86 (see FIG. 6) via a belt or the like (not depicted). Driving of the carriage motor 86 moves the carriage 2 in the scanning direction along the guide rails 11 and 12. In the following description, the right and left sides in the scanning direction are defined as indicated in FIG. 1. An up-down direction of the printer 1 is defined as indicated in FIG. 2.

The subtank 3 is mounted on the carriage 2. The printer 1 includes a cartridge holder 14. Four ink cartridges 15 are removably mounted on the cartridge holder 14. The four ink cartridges 15 respectively contain black, yellow, cyan, and magenta inks from the right side to the left side in the scanning direction. The subtank 3 is connected to the four ink cartridges 15 installed in the cartridge holder 14 via four tubes 13. This allows the inks of four colors to be supplied from the four ink cartridges 15 to the subtank 3.

The ink-jet head 4 is mounted on the carriage 2 and connected to a lower end of the subtank 3. The inks of four colors are supplied from the subtank 3 to the ink-jet head 4. Further, the ink-jet head 4 discharges the ink(s) from nozzles 10 formed in a nozzle surface 4*a*, which is a lower surface of the ink-jet head 4. More specifically, the ink-jet head 4 includes four nozzle rows 9 arranged in the scanning direction. The nozzles 10 included in each nozzle 9 are arranged in a conveyance direction (a predefined direction of the present disclosure) orthogonal to the scanning direction. The black ink is discharged from the nozzles 10 belonging to the rightmost nozzle row 9 in the scanning direction, the yellow ink is discharged from the nozzles 10 belonging to the second rightmost nozzle row 9, the cyan ink is discharged from the nozzles 10 belonging to the third rightmost nozzle row 9, and the magenta ink is discharged from the nozzles 10 belonging to the leftmost nozzle row 9.

The platen 5 is disposed below the ink-jet head 4 and faces the nozzles 10. The platen 5 extends over an entire length of a recording sheet P (a medium of the present disclosure) in the scanning direction. The platen 5 supports the recording sheet P from below. Above the platen 5, a holding member 16 is disposed upstream of the ink-jet head 4 in the conveyance direction. The holding member 16 holds an upper surface Pa (a facing surface of the present disclosure) of the recording sheet P from above, thus inhibiting the recording sheet P from floating. This inhibits variation in a distance between the nozzles 10 and the upper surface Pa of the recording sheet P.

The conveyance roller pair 6 is disposed upstream of the ink-jet head 4 and the platen 5 in the conveyance direction. The conveyance roller pair 6 has a driving roller 6*a* and a driven roller 6*b* extending in the scanning direction. The driven roller 6*b* is disposed above the driving roller 6*a*. The driven roller 6*b* is urged against the driving roller 6*a* by a spring or the like (not depicted). The conveyance roller pair 7 (a roller pair of the present disclosure) is disposed downstream of the ink-jet head 4 and the platen 5 in the conveyance direction. The conveyance roller pair 7 has a driving roller 7*a* and a driven roller 7*b* extending in the scanning direction. The driven roller 7*b* is disposed above the driving roller 7*a*. The driven roller 7*b* is urged against the driving roller 7*a* by a spring or the like (not depicted).

The driving rollers 6*a* and 7*a* are connected to a conveyance motor 87 (see FIG. 6) via gears (not depicted). Driving the conveyance motor 87 rotates the driving rollers 6*a* and 7*a*, which drives and rotates the driven rollers 6*b* and 7*b*. The recording sheet P is thus conveyed in the conveyance direction with the recording sheet P being nipped between the driving roller 6*a* and the driven roller 6*b* and between the driving roller 7*a* and the driven roller 7*b*. In the printer 1, a feeder (not depicted) selectively supplies either of a regular sheet (a first sheet of the present disclosure) or a gloss sheet (a second sheet of the present disclosure) as the recording sheet P. The driving roller pairs 6 and 7 convey the recording sheet P supplied by the feeder.

The maintenance unit 8 discharges the inks in the ink-jet head 4 from the nozzles 10 by performing a suction purge described below. The maintenance unit 8 is described below in detail.

Ink-Jet Head

Figure 3:
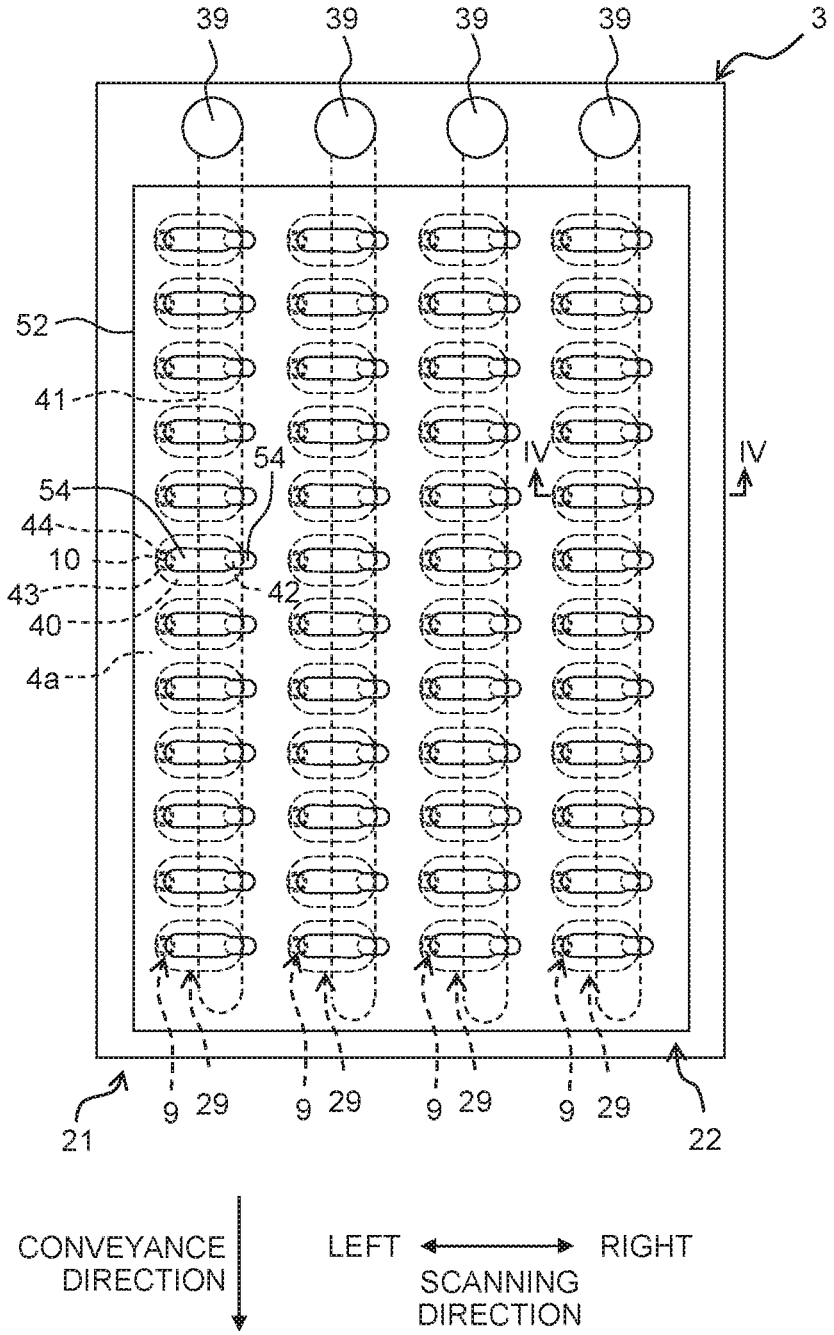
FIG. 3 is a plan view of the ink-jet head 4.
Figure 4:
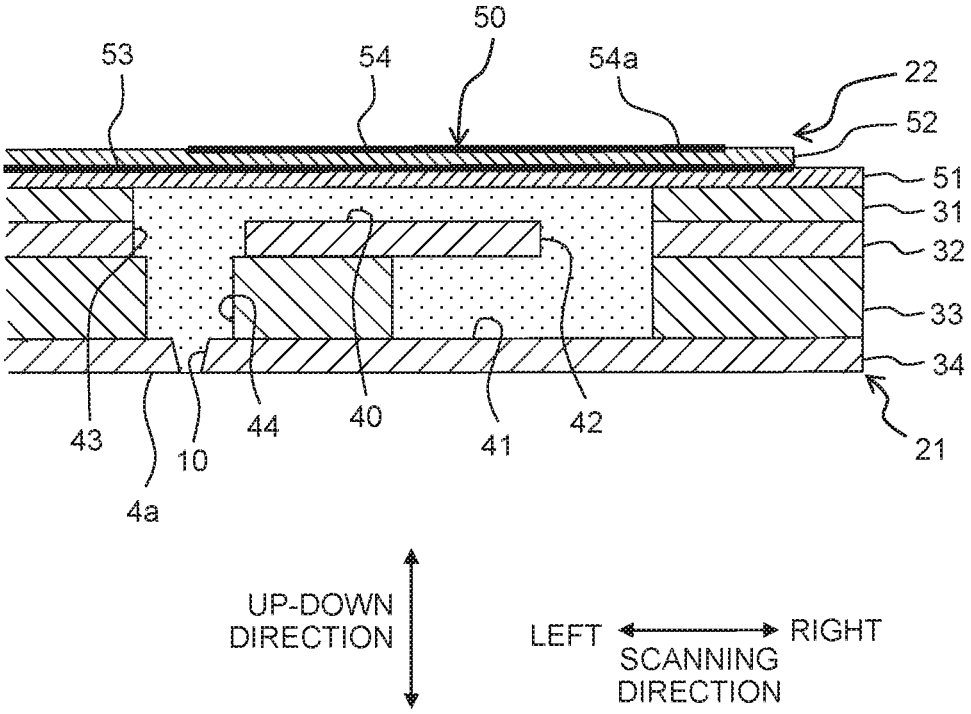
FIG. 4 is a cross-sectional view taken along a line IV-IV in FIG. 3.

Subsequently, the ink-jet head 4 is described below in detail. As depicted in FIGS. 3 and 4, the ink-jet head 4 includes a channel unit 21 and a piezoelectric actuator 22.

Channel Unit

The channel unit 21 includes four plates 31 to 34. The four plates 31 to 34 are stacked on top of each other in that order from the top. The plates 31 to 33 are made using a metal material, such as stainless steel. The plate 34 is made using a synthetic resin material, such as polyimide.

The plate 34 is formed having the nozzles 10. The nozzles 10 form the four nozzle rows 9 as described above. A lower surface of the plate 34 is the nozzle surface 4*a* of the ink-jet head 4. The plate 31 is formed having pressure chambers 40. The pressure chamber 40 has an elliptical planar shape of which longitudinal direction is the scanning direction. The pressure chambers 40 communicate with the respective nozzles 10. A left end in the scanning direction of each of the pressure chambers 40 overlaps in the up-down direction with the corresponding one of the nozzles 10. Four pressure chamber rows 29 arranged in the scanning direction are formed in the plate 31. Each pressure chamber row 29 includes the pressure chambers 40 arranged in the conveyance direction.

The plate 32 has through holes 42 at portions overlapping in the up-down direction with right ends in the scanning direction of the pressure chambers 40. Each through hole 42 is a circular opening. The plate 32 has through-holes 43 at portions overlapping in the up-down direction with the nozzles 10 and the left ends in the scanning direction of the pressure chambers 40. Each through hole 43 is a circular opening.

The plate 33 is formed having four manifold channels 41. The four manifold channels 41 communicate with the four pressure chamber rows 29, respectively. The manifold channels 41 extend in the conveyance direction. Each of the manifold channels 41 overlaps in the up-down direction with right portions in the scanning direction of the pressure chambers 40 that belongs to the corresponding one of the pressure chamber rows 29. The pressure chambers 40 communicate with the corresponding manifold channel 41 via the through holes 42. A supply opening 39 is provided at an upstream end in the conveyance direction of each manifold channel 41. The ink-jet head 4 is connected to channels in the subtank 3 via the supply openings 39. Each of the inks is thus supplied to the manifold channel 41 from the corresponding one of the supply openings 39. The plate 33 has through holes 44 at portions overlapping in the up-down direction with the through holes 43 and the nozzles 10. Each through hole 44 is a circular opening. Each of the nozzles 10 thus communicates with the corresponding one of the pressure chambers 40 via the through holes 43 and 44.

Piezoelectric Actuator

The piezoelectric actuator 22 includes a vibration plate 51, a piezoelectric layer 52, a common electrode 53, and individual electrodes 54. The vibration plate 51 is made using a piezoelectric material that includes lead zirconate titanate as a main component. The lead zirconate titanate is a mixed crystal of lead titanate and lead zirconate. The vibration plate 51 is disposed on an upper surface of the channel unit 21 to cover the pressure chambers 40. Unlike the piezoelectric layer 52 described below, the vibration plate 51 may be made using any other insulating material than the piezoelectric material.

The piezoelectric layer 52 is made using the above-described piezoelectric material. The piezoelectric layer 52 is disposed on an upper surface of the vibration plate 51 and extends continuously over the pressure chambers 40. The common electrode 53 is disposed between the vibration plate 51 and the piezoelectric layer 52 and extends continuously over the pressure chambers 40. The common electrode 53 is connected to a power circuit (not depicted) via a trace member (not depicted). The common electrode 53 is kept at a ground potential.

The individual electrodes 54 correspond to the respective pressure chambers 40. Each individual electrode 54 has an oval planar shape that is smaller to some extent than the pressure chamber 40. The individual electrodes 54 are disposed on an upper surface of the piezoelectric layer 52 and overlap in the up-down direction with the central portions of the pressure chambers 40. The right end in the scanning direction of each individual electrode 54 extends rightward in the scanning direction to a position that does not overlap in the up-down direction with the pressure chamber 40. An end portion of each individual electrode 54 is a connection terminal 54*a*. A trace member (not depicted) is connected to each connection terminal 54*a*. Each individual electrode 54 is connected to a driver IC 59 (see FIG. 6) via the trace member. The driver IC 59 selectively applies either of the ground potential or a predefined driving potential (e.g., about 20V) to the respective individual electrodes 54.

Portions of the piezoelectric layer 52 interposed between the common electrode 53 and the individual electrodes 54 are polarized in its thickness direction. In the piezoelectric actuator 22 having the above configuration, portions formed by the individual electrodes 54 and portions of the vibration plate 51, the piezoelectric layer 52, and the common electrode 53 overlapping in the up-down direction with the pressure chambers 40 serve as driving elements 50 for applying pressure to the ink in the pressure chambers 40.

A method of discharging ink from a certain nozzle 10 by driving the piezoelectric actuator 22 is explained. In the piezoelectric actuator 22, all the individual electrodes 54 are kept at the same ground potential as the common electrode 53 in advance. When ink is discharged from the certain nozzle 10, the electrical potential of the individual electrode 54 in the driving element 50 corresponding to the certain nozzle 10 is switched from the ground potential to the driving potential. This generates the potential difference between the individual electrode 54 and the common electrode 53, resulting in an electric field in the thickness direction parallel to a polarization direction in the portion of the piezoelectric layer 52 interposed between the individual electrode 54 and the common electrode 53. This electric field contracts the portion of the piezoelectric layer 52 in the horizontal direction, thus deforming a portion of the vibration plate 51 and the piezoelectric layer 52 overlapping in the up-down direction with the pressure chamber 40 so that the portion become convex toward the pressure chamber 40 as a whole. This reduces the volume of the pressure chamber 40 to increase the pressure of the ink in the pressure chamber 40, thereby discharging ink from the nozzle 10 communicating with the pressure chamber 40.

Maintenance Unit

Next, the maintenance unit 8 is explained. As depicted in FIG. 1, the maintenance unit 8 includes a cap 61, a suction pump 62, and a waste liquid tank 63. The cap 61 is disposed on the right side in the scanning direction from the platen 5. When the carriage 2 is positioned at the maintenance position on the right side in the scanning direction from the platen 5, the nozzles 10 face the cap 61.

The cap 61 can move up and down by a cap lifting mechanism 88 (see FIG. 6). The cap 61 is moved upward by the cap lifting mechanism 88 in a state where the carriage 2 is positioned at the maintenance position with the nozzles 10 facing the cap 61. In this situation, an upper end of the cap 61 is in close contact with the nozzle surface 4*a* and the nozzles 10 are covered with the cap 61. The cap 61 covers the nozzles 10 by being in close contact the nozzle surface 4*a*. The present disclosure, however, is not limited to such an aspect. For example, the cap 61 may cover the nozzles 10 by being in close contact with a frame (not depicted) or the like disposed around the nozzle surface 4*a* of the ink-jet head 4.

The suction pump 62 is a tube pump or the like. The suction pump 62 is connected to the cap 61 and the waste liquid tank 63. As described above, the suction pump 62 is driven in the state where the nozzles 10 are covered with the cap 61. In this situation, the inks in the ink-jet head 4 are discharged from the nozzles 10. Such an ink discharge operation is referred to as the suction purge (a discharge operation of the present disclosure). Namely, the maintenance unit 8 can perform the suction purge. The inks discharged from the ink-jet head 4 are held in the waste liquid tank 63. In this embodiment, the maintenance unit 8 including the cap 61 and the suction pump 62 corresponds to a discharge mechanism of the present disclosure.

The above explanation has been made on the assumption that the cap 61 covers all the nozzles 10 collectively and the inks in the ink-jet head 4 are discharged from all the nozzles 10 in the suction purge, for the sake of convenience. The present disclosure, however, is not limited to such an aspect. For example, the cap 61 may include a portion covering the nozzles 10 belonging to the rightmost nozzle row 9 from which the black ink is discharged and another portion covering the nozzles 10 belonging to the remaining three nozzle rows 9 from which color inks (yellow, cyan, and magenta inks) are discharged. In the suction purge, the maintenance unit 8 may selectively discharge any of the black ink and the color inks in the ink-jet head 4.

Figure 5:
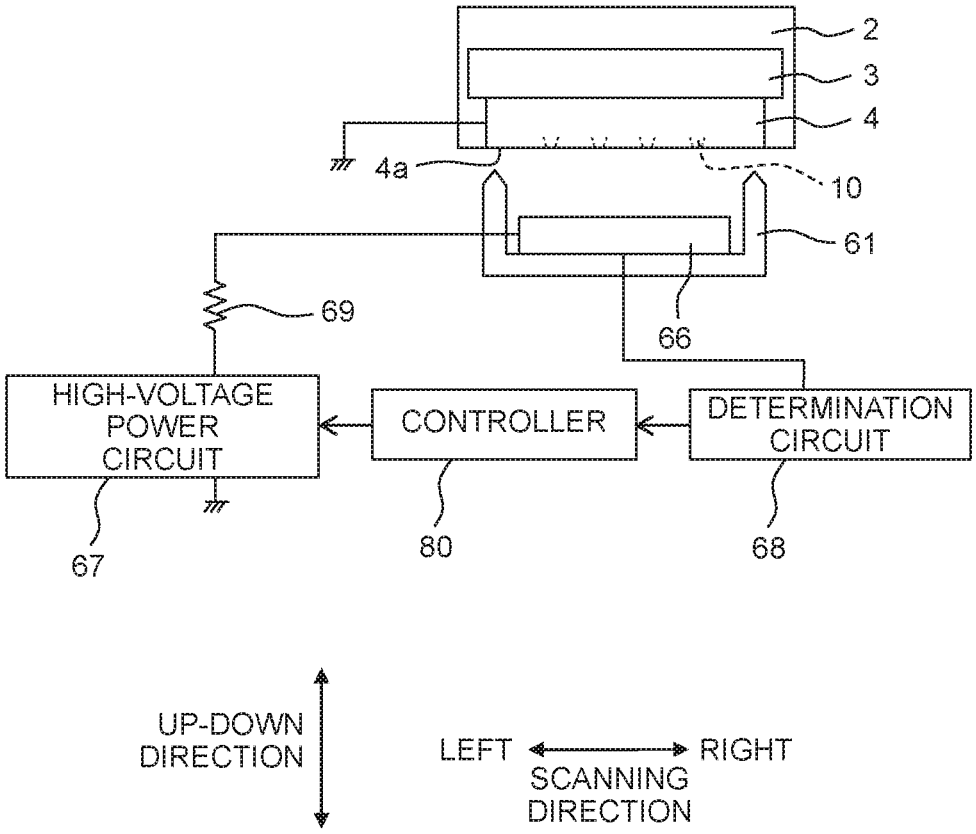
FIG. 5 depicts a detection electrode 66 disposed in a cap 61, and illustrates a connection relationship between the electrode 66 and a high-voltage power circuit 67 and a connection relationship between the electrode 66 and a determination circuit 68.

As depicted in FIG. 5, a detection electrode 66 having a rectangular shape in plan view is disposed in the cap 61. The electrode 66 is connected to a high-voltage power circuit 67 via a resistance 69. The high-voltage power circuit 67 applies a predefined positive potential (e.g., about 300 V) to the electrode 66. The channel unit 21 of the ink-jet head 4 is kept at the ground potential. This generates a predefined potential difference between the ink-jet head 4 and the electrode 66. A determination circuit 68 (a signal output circuit of the present disclosure) is connected to the electrode 66. The determination circuit 68 compares a voltage value of a voltage signal output from the electrode 66 with a threshold value Vt, and outputs a signal depending on the result.

Figure 6A:
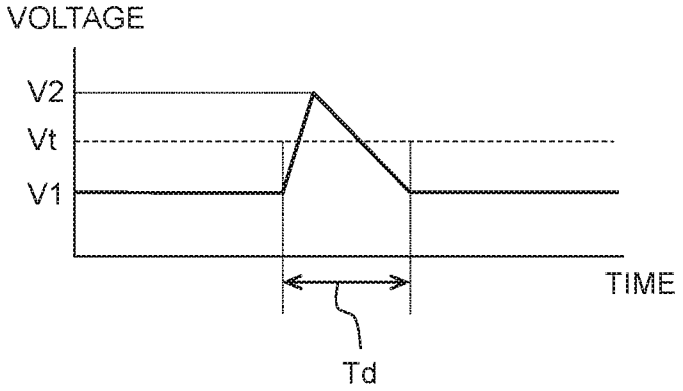
FIG. 6A depicts a change in voltage value of the electrode 66 when ink is discharged from a nozzle 10.

More specifically, since the potential difference is generated between the ink-jet head 4 and the electrode 66, the ink discharged from the nozzle 10 is charged. Ink is discharged from the nozzle 10 toward the electrode 66 in a state where the carriage 2 is positioned at the maintenance position. As depicted in FIG. 6A, the voltage value of the electrode 66 increases until the charged ink approaches the electrode 66 and lands on the electrode 66. The voltage value of the electrode 66 reaches a voltage value V2 higher than a voltage value V1 obtained when the ink-jet head 4 is not driven. After the charged ink has landed on the electrode 66, the voltage value of the electrode 66 gradually decreases to the voltage value V1. That is, the voltage value of the electrode 66 changes during a driving period Td of the ink-jet head 4.

Figure 6B:
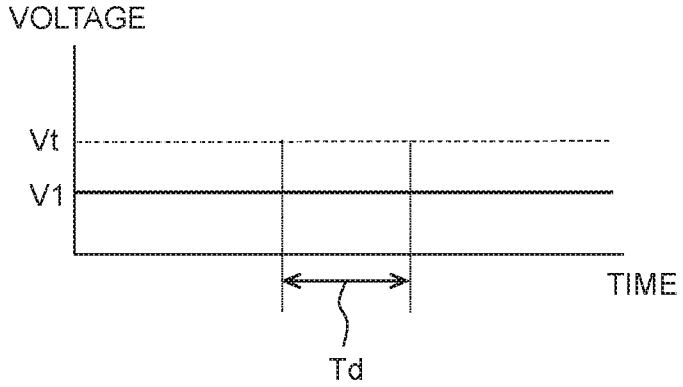
FIG. 6B depicts a change in voltage value of the electrode 66 when no ink is discharged from the nozzle 10.

When ink is not discharged from the nozzle 10, as depicted in FIG. 6B, the voltage value of the voltage signal output from the electrode 66 during the driving period Td of the ink-jet head 4 hardly changes from the voltage value V1. Thus, the threshold value Vt ($V1<Vt<V2$) is set in the determination circuit 68 to distinguish these voltage values. The determination circuit 68 compares a maximum voltage value of the voltage signal output from the electrode 66 with the threshold value Vt during the driving period Td of the ink-jet head 4, and outputs a signal corresponding to the determination result.

The high-voltage power circuit 67 may apply a positive potential to the electrode 66. The high-voltage power circuit 67 may apply a negative potential to the electrode 66 (e.g., about 300V). When the negative potential is applied, the change in voltage value of the electrode 66 is reversed to the case in which the positive potential is applied. Namely, when ink is discharged from the nozzle 10 toward the electrode 66 in a state where the carriage 2 is positioned at the maintenance position, the voltage value of the electrode 66 decreases until the charged ink approaches the electrode 66 and lands on the electrode 66.

Electrical Configuration of Printer

Figure 7:
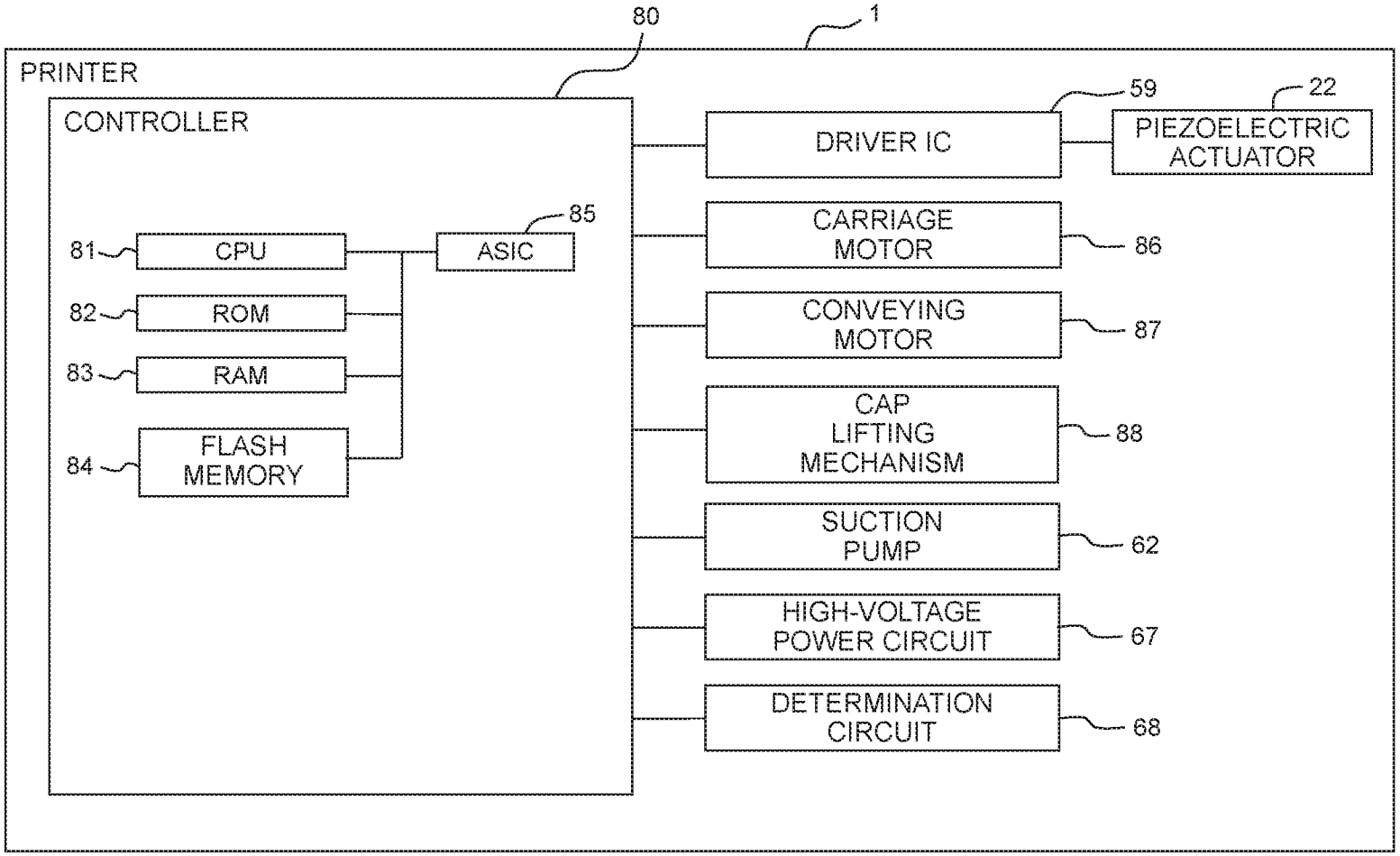
FIG. 7 is a block diagram depicting an electrical configuration of the printer 1.

Next, an electrical configuration of the printer 1 is explained. The operation of the printer 1 is controlled by a controller 80. As depicted in FIG. 7, the controller 80 includes a Central Processing Unit (CPU) 81, a Read Only Memory (ROM) 82, a Random Access Memory (RAM) 83, a flash memory 84, an Application Specific Integrated Circuit (ASIC) 85, and the like. The controller 80 controls operations of the carriage motor 86, the conveyance motor 87, the driver IC 59, the cap lifting mechanism 88, the high-voltage power circuit 67, the suction pump 62, and the like. Further, the above-described signal is input from the determination circuit 68 to the controller 80.

In the controller 80, only the CPU 81 may perform a variety of processes, only the ASIC 85 may perform a variety of processes, or the CPU 81 may cooperate with the ASIC 85 to perform a variety of processes. In the controller 80, one CPU 81 may perform a process alone, or a plurality of CPU 81 may perform a process in a shared fashion. In the controller 80, one ASIC 85 may perform a process alone, or a plurality of ASIC 85 may perform a process in a shared fashion.

Image Recording

Subsequently, image recording on the recording sheet P by the printer 1 is explained. The printer 1 records an image on the recording sheet P by alternatingly performing a recording pass and a conveyance operation. In the recording pass, the controller 80 controls the ink-jet head 4 to discharge ink from the nozzles 10 on the recording sheet P during the movement in the scanning direction of the carriage 2. In the conveyance operation, the controller 80 controls the conveyance roller pairs 6 and 7 to convey the recording sheet P in the conveyance direction.

he printer 1 can record an image on the recording sheet P by causing the controller 80 to selectively use either of a high speed recording mode (an entire discharge mode of the present disclosure) or a high image quality recording mode (a partial discharge mode of the present disclosure). In the recording pass using the high speed recording mode, all the nozzles 10 belonging to each nozzle row 9 are used. This maximizes a length in the conveyance direction of an area to be recorded by one recording pass, thus reducing the number of execution times of the recording pass until the recording on the recording sheet P is completed. Recording can be thus performed at high speed.

There may be some play between the carriage 2 and the guide rails 11, 12. In the recording pass, the carriage 2 may be tilted during its movement, which may lead to a position shift in the scanning direction between the nozzles 10 belonging to each nozzle row 9. The position shift in the scanning direction becomes larger, as an interval in the conveyance direction between the nozzles 10 is longer. Thus, in the recording pass using the high image quality recording mode, only part of the nozzles 10 belonging to each nozzle row 9 and continuously arranged in the conveyance direction are used. This reduces the interval between the nozzles 10 that are included in the nozzles 10 used in the recording pass and that have a longest interval in the conveyance direction. The position shift in the scanning direction between the nozzles 10 belonging to each nozzle row 9 is thus as small as possible. This reduces a position shift in the scanning direction between dots on the recoding sheet P formed by ink discharged from the nozzles 10 belonging to each nozzle row 9, thus improving the quality of an image to be recorded. In the following, the part of the nozzles used when an image is recorded on the recording paper P using the high image quality recording mode may be referred to as use nozzles.

In this embodiment, image recording is performed by discharging the inks of four colors from the nozzles 10 belonging to the four nozzle rows 9 of the ink-jet head 4, both when recording is performed using the high speed recording mode and when recording is performed using the high image quality recording mode.

Control in Recording

Next, a series of processes in recording of the controller 80 is explained. When the printer 1 records an image on the recording paper P, the controller 80 performs processes in accordance with the flowchart of FIG. 8. The flowchart of FIG. 8 starts when a recording instruction for instructing the printer 1 to record an image on the recording paper P is input.

Figure 8:
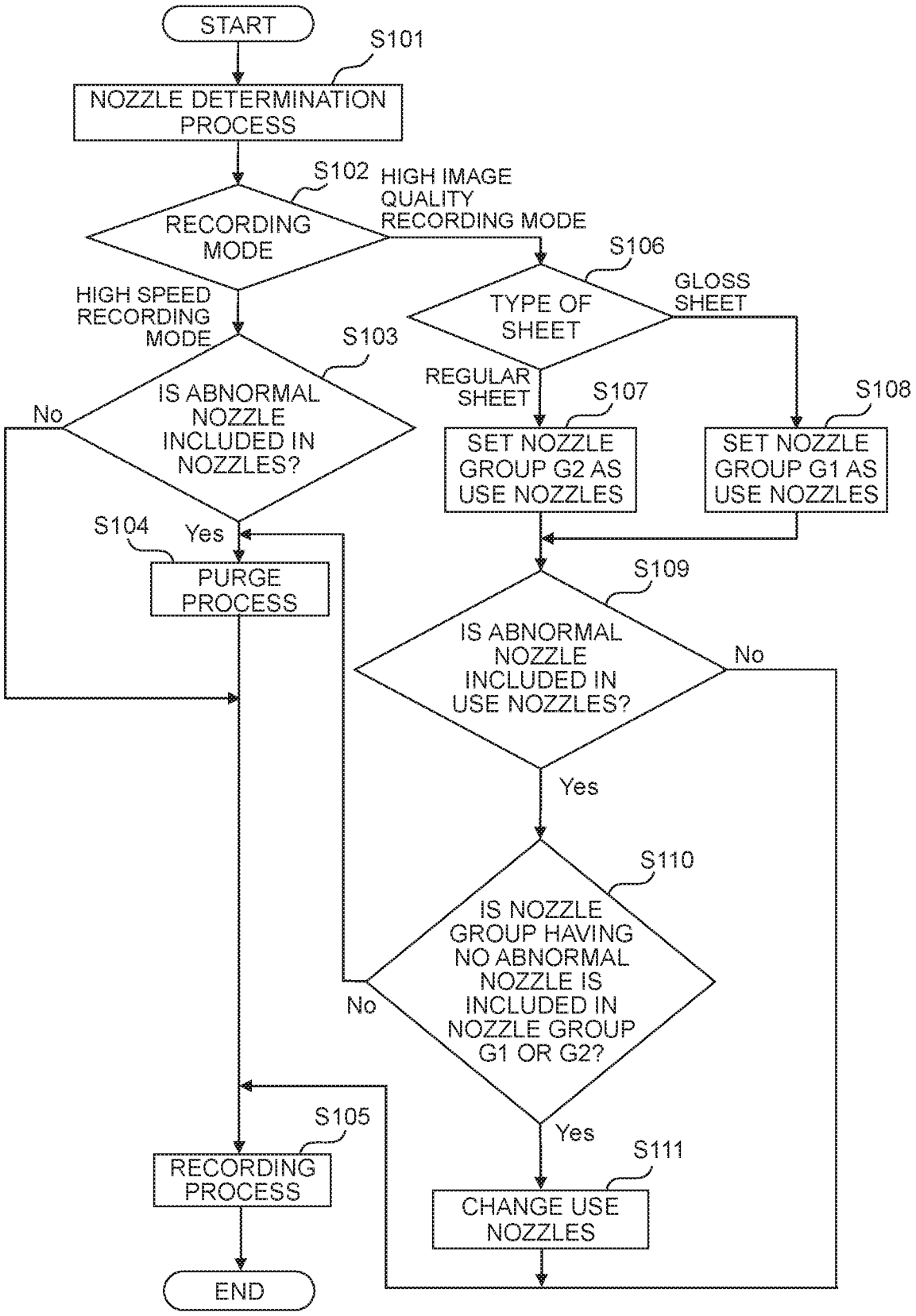
FIG. 8 is a flowchart indicating a series of processes in recording.

The flowchart of FIG. 8 is explained below more specifically. The controller 80 first performs a nozzle determination process (S101). In the nozzle determination process, the controller 80 controls the carriage motor 86 to move the carriage 2 to the maintenance position. Then, the controller 80 controls the ink-jet head 4 to discharge ink from one of the nozzles 10 toward the electrode 66. This causes the determination circuit 68 to output a signal, which varies depending on whether ink is discharged from the one nozzle 10. The controller 80 thus determines whether the nozzle 10 is the discharge-defective nozzle based on the signal from the determination circuit 68. Ink may not be discharged properly from the nozzle 10 due to, for example, the increase in viscosity caused by the drying of ink in the nozzle 10. In other words, the discharge performance of the nozzle 10 may be lower than the predetermined discharge performance. Examples of the predetermined discharge performance include whether or not an ink droplet of a predetermined size can be jetted, whether or not the ink droplet can be jetted at a predetermined speed, and whether or not the ink droplet can be jetted in a predetermined direction. The nozzle 10 from which ink cannot be discharged properly is referred to as "a discharge-defective nozzle". In this embodiment, when the signal from the determination circuit 68 indicates that no ink is discharged from the nozzle 10, the controller 80 determines that the nozzle 10 is the discharge-defective nozzle. In S101, the controller 80 determines whether each of the nozzles 10 of the ink-jet head 4 is the discharge-defective nozzle as described above. Although the controller 80 can perform the above determination for all the nozzles 10, the controller 80 can perform the above determination for part of the nozzles 10 as needed. Namely, the controller 80 can perform the above determination for at least one nozzle 10.

Subsequently, the controller 80 determines the recording mode based on the recording instruction input (S102). Specifically, the controller 80 determines whether image recording is performed using the high speed recording mode or the high image quality recording mode. For example, any of the recording modes may be set in the printer 1 in advance. When the printer 1 is set in advance to use the high speed recording mode, the controller 80 may directly proceed to a process in S103 described below after the process in S101. When the printer 1 is set in advance to use the high image quality recording mode, the controller 80 may directly proceed to a process in S106 described below after the process in S101.

When image recording is performed using the high speed recording mode (S102: high speed recording mode), the controller 80 determines based on the determination result in S101 whether the nozzles 10 of the ink-jet head 4 include the discharge-defective nozzle (S103). When the nozzles 10 of the ink-jet head 4 include the discharge-defective nozzle (S103: YES), the controller 80 performs the purge process for performing the above suction purge (S104), and then performs the recording process (S105). When the nozzles 10 of the ink-jet head 4 do not include the discharge-defective nozzle (S103: NO), the controller 80 performs the recording process (S105) without performing the purge process. After completing the recording process, the controller 80 ends the series of processes in FIG. 8. In the recording process of S105, the controller 80 performs the image recording on the recording sheet P by alternatingly performing the recording pass and the conveyance operation.

When image recording is performed using the high image quality recording mode (S102: high image quality recording mode), the controller 80 determines the type of the recording sheet P (S106). Specifically, the controller 80 determines whether the recording sheet P is the regular sheet or the gloss sheet.

Figure 9:
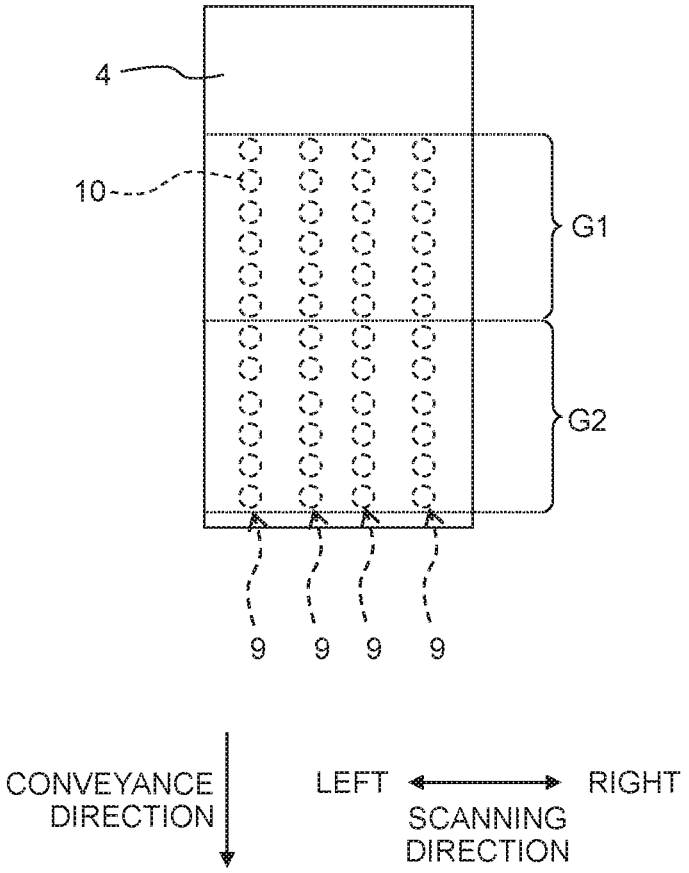
FIG. 9 illustrates nozzle groups G1 and G2.

As depicted in FIG. 9, information of a nozzle group G1 and information of a nozzle group G2 are memorized in the flash memory 84 (a memory of the present disclosure) of the printer 1. The nozzle group G1 is formed by nozzles 10 included in the nozzles 10 of the ink-jet head 4 and corresponding to an upstream half portion in the conveyance direction. The nozzle group G2 is formed by nozzles 10 included in the nozzles 10 of the ink-jet head 4 and corresponding to a downstream half portion in the conveyance direction.

When the recording sheet P is the regular sheet (S106: regular sheet), the controller 80 sets, as the use nozzles, the nozzles 10 belonging to the nozzle group G2 disposed at the downstream side in the conveyance direction (S107). When the recording sheet P is the gloss sheet (S106: gloss sheet), the controller 80 sets, as the use nozzles, the nozzles 10 belonging to the nozzle group G1 disposed at the upstream side in the conveyance direction (S108). When the controller 80 has set the use nozzles in S107 or S108, the controller 80 also sets corresponding relationships between dots forming an image to be recorded and respective nozzles 10 included in the nozzles 10 and related to the dot formation. The same applies to a case in which the use nozzles are changed in S111 described below. In this embodiment, the nozzles 10 belonging to the nozzle group G2 when the recording sheet P is the regular sheet and the nozzles 10 belonging to the nozzle group G1 when the recording sheet P is the gloss sheet correspond to a first nozzle of the present disclosure.

After S107 or S108, the controller 80 determines based on the determination result in S101 whether the use nozzles include the discharge-defective nozzle (S109). When the use nozzles include no discharge-defective nozzle (S109: NO), the controller 80 performs the recording process (S105) and ends the series of processes in FIG. 8.

When the use nozzles include the discharge-defective nozzle (S109: YES), the controller 80 determines whether a nozzle group having no discharge-defective nozzle is included in the nozzle group G1 or G2 (S110). Specifically, when the nozzles 10 belonging to the nozzle group G2 are set as the use nozzles (S107), the controller 80 determines whether the nozzles 10 belonging to the nozzle group G1 include the discharge-defective nozzle. When the nozzles 10 belonging to the nozzle group G1 are set as the use nozzles (S108), the controller 80 determines whether the nozzles 10 belonging to the nozzle group G2 include the discharge-defective nozzle.

When the nozzle group having no discharge-defective nozzle is included in the nozzle group G1 or G2 (S110: YES), the controller 80 changes the use nozzles from the currently set nozzles 10 to nozzles 10 belonging to the nozzle group having no discharge-defective nozzle (S111). Then, the controller 80 performs the recording process (S105) and ends the series of processes in FIG. 8. When there is no nozzle group having no discharge-defective nozzle (S110: NO), the controller 80 performs the purge process (S104), performs the recording process (S105), and ends the series of processes in FIG. 8. In this embodiment, the nozzles 10 belonging to the nozzle group G1 when the recording sheet P is the regular sheet and the nozzles 10 belonging to the nozzle group G2 when the recoding sheet P is the gloss sheet correspond to a second nozzle of the present disclosure.

Effects

Image recording may be performed on the recording sheet P by using the high image quality recording mode in which only part of the nozzles 10 (use nozzles) included in the nozzles 10 belonging to the nozzle row 9 and continuously arranged in the conveyance direction are used to perform recording. In that case, when the nozzles 10 include the discharge-defective nozzle, the controller 80 sets the use nozzles not to include the discharge-defective nozzle. This eliminates the suction purge before recording, and ink can appropriately land on the recording sheet P. A time after a recording instruction for instructing the printer 1 to record an image on the recording paper P is input until image recording on the recording sheet P is completed is thus made as short as possible.

As described above, when an image is recorded on the recording sheet P using the high image quality recording mode, the suction purge before recording is not indispensable, even when the discharge-defective nozzle is included. This reduces an ink discharge amount. Image recording may be performed on the recording sheet P by using the high speed recording mode in which all the nozzles 10 belonging to the nozzle row 9 are used. In that case, when the discharge-defective nozzle is included in the nozzles 10 of the ink-jet head 4, image recording on the recording sheet P is performed after the suction purge. This recovers the discharge performance of the discharge-defective nozzle before recording, which allows ink to appropriately land on the recording sheet P.

In this embodiment, information of the two nozzle groups G1 and G2 is memorized in the flash memory 84. When the nozzles 10 belonging to one of the two nozzle groups G1 and G2 include no discharge-defective nozzle, the controller 80 sets the nozzles 10 belonging to the one nozzle group as the use nozzles. When the nozzles 10 belonging to the one nozzle group include the discharge-defective nozzle and the nozzles 10 belonging to the other nozzle group include no discharge-defective nozzle, the controller 80 sets the nozzles 10 belonging to the other nozzle group as the use nozzles. In that configuration, even when the discharge-defective nozzle is included in any of the nozzle groups, the use nozzles can be set not to include the discharge-defective nozzle. Since an appropriate nozzle group is selected from among the previously memorized nozzle groups G1 and G2 and the nozzles 10 belonging to the selected nozzle group are set as the use nozzles, the process for setting the use nozzles can be performed easily.

In this embodiment, an image is recorded on the recording sheet P by alternatingly repeating the recording pass and the conveyance operation. This allows ink to land on the same position in the conveyance direction of the recording sheet P by adjusting a conveyance amount of the recoding sheet P in the conveyance operation, even when the nozzles 10 set as the use nozzles are changed.

Ink landing on the recording sheet P permeates the recording sheet P and the recording sheet P swells. The swelling of the recording sheet P results in a height difference between a portion of the recording sheet P on which ink has landed and a surrounding portion thereof, which varies the distance between the nozzles 10 and the recording sheet P. Ink is less likely to permeate the gloss sheet than the regular sheet, and thus the gloss sheet is less likely to cause swelling than the regular sheet. In the printer 1, the conveyance roller pair 7, which conveys the recording sheet P while nipping it, is disposed downstream of ink-jet head 4 in the conveyance direction. The holding member 16, which inhibits the floating of the recording sheet P, is disposed upstream of the ink-jet head 4 in the conveyance direction.

In this embodiment, (1) when the recording sheet P is the regular sheet that is likely to swell, and (2) when no discharge-defective nozzle is included in the nozzles 10 belonging to the nozzle group G2 disposed at the downstream side in the conveyance direction, the controller 80 sets the nozzles 10 belonging to the nozzle group G2 as the use nozzles. In that configuration, after ink landed on a first area of the recording sheet P in an earlier recording pass, when ink is to be discharged on a second area upstream of the first area in the conveyance direction in a later recording pass, the first area is nipped by the conveyance roller pair 7. This inhibits a distance between the second area of the recording sheet P and the nozzles 10 from being affected by the swelling of the first area, which allows ink to land on an appropriate position in the second area of the recording sheet P.

Further, (1) when the recording sheet P is the regular sheet, (2) when the discharge-defective nozzle is included in the nozzles 10 belonging to the nozzle group G2, and (3) when no discharge-defective nozzle is included in the nozzles 10 belonging to the nozzle group G1 disposed at the upstream side in the conveyance direction, the controller 80 sets the nozzles 10 belonging to the nozzle group G1 as the use nozzles. This allows ink to appropriately land on the recording sheet P without performing the suction purge before recording. A time after a recording instruction for instructing the printer 1 to record an image on the recording paper P is input until image recording on the recording sheet P is completed is thus shortened.

On the other hand, (1) when the recording sheet P is the gloss sheet that is not likely to cause swelling, and (2) when no discharge-defective nozzle is included in the nozzles 10 belonging to the nozzle group G1 disposed at the upstream side in the conveyance direction, the controller 80 sets the nozzles 10 belonging to the nozzle group G1 as the use nozzles. In that configuration, ink is discharged from the nozzles 10 toward a portion of the recording sheet P close to the holding member 16 and having a stable distance between the nozzles 10 and the recording sheet P in each recording pass, thus stabilizing landing positions of ink on the recording sheet P.

Further, (1) when the recording sheet P is the gloss sheet, (2) when the discharge-defective nozzle is included in the nozzles 10 belonging to the nozzle group G1, and (3) when no discharge-defective nozzle is included in the nozzles 10 belonging to the nozzle group G2 disposed at the downstream side in the conveyance direction, the controller 80 sets the nozzles 10 belonging to the nozzle group G2 as the use nozzles. This allows ink to appropriately land on the recording sheet P without performing the suction purge before recording. A time after a recording instruction for instructing the printer 1 to record an image on the recording paper P is input until image recording on the recording sheet P is completed is thus shortened.

Modified Embodiments

The embodiment of the present disclosure is explained above. The present disclosure, however, is not limited to the above embodiment. Various changes or modifications may be made without departing from the claims.

In the above embodiment, the recording sheet P is either of the regular sheet or the gloss sheet. The present disclosure, however, is not limited thereto. For example, the recording sheet P may be any of multiple kinds of recording sheets that are different in the easiness of permeation of the ink landing thereon. The recording sheet included in the multiple kinds of the recording sheets and into which ink is more likely to permeate corresponds to a first sheet of the present disclosure. The recording sheet included in the multiple kinds of the recording sheets and into which ink is less likely to permeate corresponds to a second sheet of the present disclosure.

In the above embodiment, when the recording sheet P is the gloss sheet (S106: gloss sheet), the controller 80 sets the nozzles 10 belonging to the nozzle group G1 disposed at the upstream side in the conveyance direction as the use nozzles (S108). When the recording sheet P is the regular sheet (S106: regular sheet), the controller 80 sets the nozzles 10 belonging to the nozzle group G2 disposed at the downstream side in the conveyance direction as the use nozzles (S107). The present disclosure, however, is not limited to such an aspect.

For example, the controller 80 may set the nozzles 10 belonging to the nozzle group G2 disposed at the downstream side in the conveyance direction as the use nozzles irrespective of the type of the recording sheet P. In that case, (1) when the discharge-defective nozzle is included in the nozzles 10 belonging to the nozzle group G2 and (2) when no discharge-defective nozzle is included in the nozzles 10 belonging to the nozzle group G1, the controller 80 may change the use nozzles to the nozzles 10 belonging to the nozzle group G1 disposed at the upstream side in the conveyance direction. This may eliminate the holding member 16.

Or, the controller 80 may set the nozzles 10 belonging to the nozzle group G1 disposed at the upstream side in the conveyance direction as the use nozzles irrespective of the type of the recording sheet P. Further, (1) when the discharge-defective nozzle is included in the nozzles 10 belonging to the nozzle group G1 and (2) when no discharge-defective nozzle is included in the nozzles 10 belonging to the nozzle group G2, the controller 80 may change the use nozzles to the nozzles 10 belonging to the nozzle group G2 disposed at the downstream side in the conveyance direction.

In the above embodiment, the nozzles 10 belonging to each nozzle row 9 are divided into the two nozzle groups. The present disclosure, however, is not limited to such an aspect. The nozzles 10 belonging to the nozzle row 9 may be divided into three or more nozzle groups. In that case, for example, the controller 80 sets the nozzles 10 belonging to one of the three or more nozzle groups as the use nozzles in advance. The controller 80 changes the use nozzles to the nozzles 10 belonging to a nozzle group that includes no discharge-defective nozzle, (1) when the discharge-defective nozzle is included in the nozzles 10 belonging to the one of the nozzle groups and (2) when no discharge-defective nozzle is included in the nozzles 10 belonging to any of the remaining nozzle groups.

In the above embodiment, the nozzles 10 belonging to each nozzle row 9 are divided into multiple nozzle groups. Information about each nozzle group is memorized in the flash memory 84. Then, the nozzles 10 belonging to any of the nozzle groups are set as the use nozzles. The present disclosure, however, is not limited to such an aspect.

Figure 10:
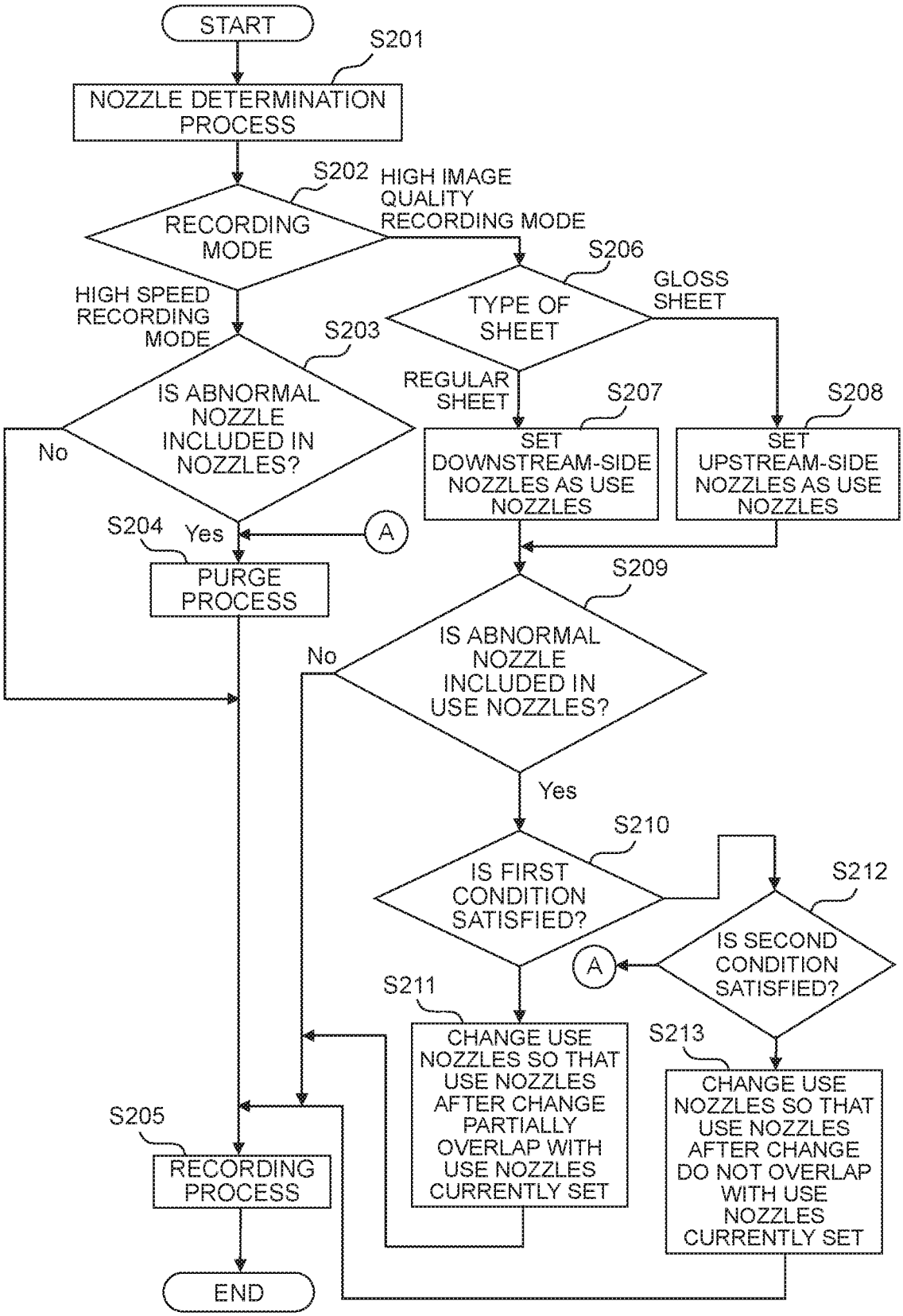
FIG. 10 is a flowchart indicating a series of processes in recording according to the first modified embodiment.

For example, in the first modified embodiment, no information about each nozzle group may be memorized in the flash memory 84. The controller 80 may set any nozzles 10 belonging to each nozzle row 9 as the use nozzles. In the first modified embodiment, the controller 80 performs processes in accordance with the flowchart of FIG. 10 when a printer records an image on the recording sheet P.

More specifically, the controller 80 performs the nozzle determination process (S201) similarly to S101 in the above embodiment. When image recording is performed using the high speed recording mode (S202: high speed recording mode), the controller 80 performs the processes of S203 to S205, which are similar to the processes of S103 to S105 in the above embodiment. When image recording is performed using the high image quality recording mode (S202: high image quality recording mode), and when the recording sheet P is the regular sheet (S206: regular sheet), the controller 80 sets the nozzles 10 belonging to a downstream half portion of the nozzle row 9 as the use nozzles (S207). When the recording sheet P is the gloss sheet (S206: gloss sheet), the controller 80 sets the nozzles 10 belonging to an upstream half portion of the nozzle row 9 as the use nozzles (S208). In the first modified embodiment, the nozzles 10 set as the use nozzles in S207 or S208 correspond to the first nozzle of the present disclosure.

After setting the use nozzles in S207 or S208, the controller 80 determines whether the discharge-defective nozzle is included in the use nozzles currently set (S209). When no discharge-defective nozzle is included in the use nozzles currently set (S209: NO), the controller 80 proceeds to a recording process in S205.

When the discharge-defective nozzle is included in the use nozzles currently set (S209: YES), the controller 80 determines whether a first condition is satisfied (S210). The first condition is a condition by which the discharge-defective nozzle is excluded by changing the nozzles 10 set as the use nozzles from the use nozzles currently set to nozzles 10 shifted in the conveyance direction in a range partially overlapping with the use nozzles currently set.

When the first condition is satisfied (S210: YES), the controller 80 excludes the discharge-defective nozzle (S211) by changing the nozzles 10 set as the use nozzles from the use nozzles currently set to the nozzles 10 shifted in the conveyance direction in the range partially overlapping with the use nozzles currently set. Then, the controller 80 proceeds to the recording process in S205. In that case, from among the first nozzles (the use nozzles set in S207 or S208), one first nozzle that is not the discharge-defective nozzle or part of the first nozzles that are not the discharge-defective nozzle and are arranged continuously in the conveyance direction, and another nozzle 10 (a second nozzle of the present disclosure) that is not the discharge-defective nozzle, arranged continuously to the part of the first nozzles in the conveyance direction, and different from the first nozzles, as the use nozzles. The number of the use nozzles after the change in S211 is the same as the number of the use nozzles set in S207 or S208.

When the first condition is not satisfied (S210: NO), the controller 80 determines whether a second condition is satisfied (S212). The second condition is a condition by which the discharge-defective nozzle is excluded by changing the nozzles 10 set as the use nozzles from the use nozzles currently set to nozzles 10 shifted in the conveyance direction beyond the range partially overlapping with the use nozzles currently set.

When the second condition is satisfied (S212: YES), the controller 80 excludes the discharge-defective nozzle (S213) by changing the nozzles 10 set as the use nozzles from the use nozzles currently set to the nozzles 10 shifted in the conveyance direction beyond the range partially overlapping with the use nozzles currently set. Then, the controller 80 proceeds to the recording process in S205. In that case, nozzles 10 that do not overlap with the use nozzles set in S207 or S208 are set as the use nozzles. The number of the use nozzles after the change in S213 is the same as the number of the use nozzles set in S207 or S208.

When both the first condition and the second condition are not satisfied (S210: NO, S212: NO), the controller 80 performs the purge process in S204 and then performs the recording process in S205.

As described above, the position shift in the scanning direction becomes larger, as an interval in the conveyance direction between the nozzles 10 is longer. The use nozzles set in S207 or S208 may be greatly apart in the conveyance direction from the use nozzles after the change in S211 or S213. In that case, the landing positions in the scanning direction of ink on the recording sheet P when recording is performed using the use nozzles set in S207 or S208 may be different from the landing positions in the scanning direction of ink on the recording sheet P when recording is performed using the use nozzles after the change in S211 or S213.

In view of the above, in the first modified embodiment, when the discharge-defective nozzle is not included in the use nozzles set in S207 or S208, recording is performed using the use nozzles set in S207 or S208. On the other hand, (1) when the discharge-defective nozzle is included in the use nozzles set in S207 or S208 and (2) when the first condition is satisfied, the controller 80 changes the use nozzles so that the use nozzles after the change partially overlap with the use nozzles set in S207 or S208. In that configuration, it is possible to make the distance in the conveyance direction between the use nozzles set in S207 or S208 and the use nozzles after the change in S211 or S213 as short as possible. Thus, it is possible to make the positional shifts in the scanning direction of ink on the recording sheet P between the case in which recording is performed using the use nozzles set in S207 or S208 and the case in which recording is performed using the use nozzles after the change in S211 or S213 as small as possible.

Further, (1) when the discharge-defective nozzle is included in the use nozzles set in S207 or S208, (2) when the first condition is not satisfied, and (3) when the second condition is satisfied, the controller 80 changes the use nozzles so that the use nozzles after the change do not overlap with the use nozzles set in S207 or S208. In that configuration, although the use nozzles set in S207 or S208 are greatly apart in the conveyance direction from the use nozzles after the change in S211 or S213, recording can be performed without performing the suction purge.

In the above embodiment, the nozzles 10 belonging to the nozzle group G1 do not overlap with the nozzles 10 belonging to the nozzle group G2. The present disclosure, however, is not limited to such an aspect. For example, the nozzle group G1 may be formed by nozzles 10 included in the nozzles 10 belonging to each nozzle row 9 and corresponding to two-thirds disposed at the upstream side in the conveyance direction. The nozzle group G2 may be formed by nozzles 10 included in the nozzles 10 belonging to each nozzle row 9 and corresponding to two-thirds disposed at the downstream side in the conveyance direction. Namely, part of the nozzles 10 belonging to the two different nozzle groups may overlap with each other.

In the above embodiment, when the use nozzles are changed, the number of use nozzles after the change is the same as the number of the use nozzles before the change. The present disclosure, however, is not limited to such an aspect.

Figure 11:
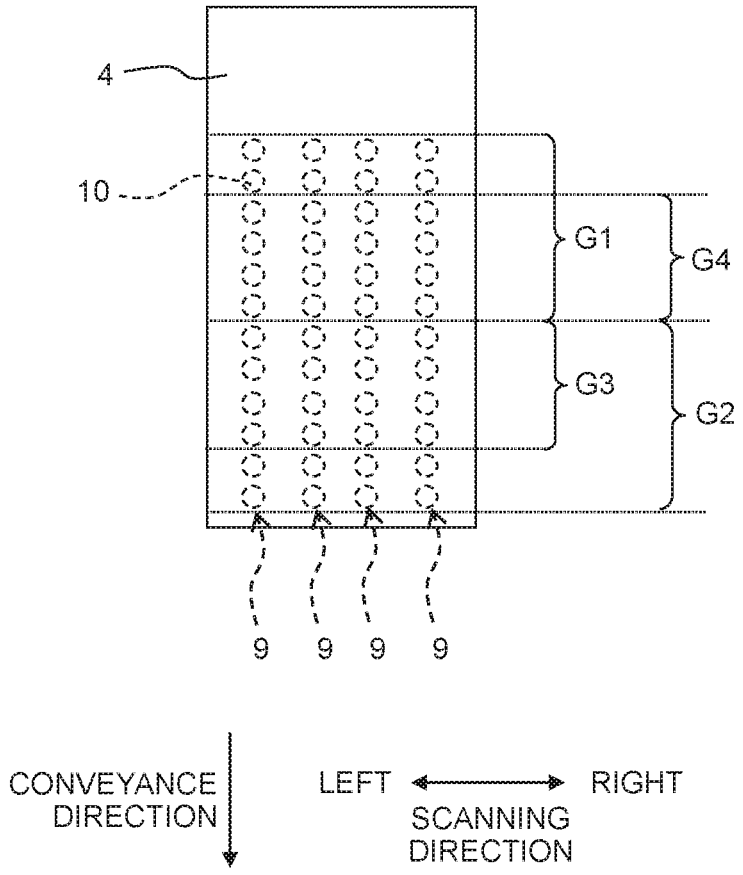
FIG. 11 illustrates nozzle groups G1 to G4 according to the second modified embodiment.

For example, in the second modified embodiment, not only the information about the nozzle groups G1 and G2 described in the above embodiment but also information about nozzle groups G3 and G4 are memorized in the flash memory 84, as depicted in FIG. 11. The nozzle group G3 is formed by nozzles 10 that are positioned downstream of the nozzle group G1 in the conveyance direction and that are arranged continuously in the conveyance direction. The number of the nozzles 10 belonging to the nozzle group G3 is smaller than the number of the nozzles 10 belonging to the nozzle group G1. The nozzle group G4 is formed by nozzles 10 that are positioned upstream of the nozzle group G2 in the conveyance direction and that are arranged continuously in the conveyance direction. The number of the nozzles 10 belonging to the nozzle group G4 is smaller than the number of the nozzles 10 belonging to the nozzle group G2.

Also in the second modified embodiment, the controller 80 performs processes in accordance with the flowchart of FIG. 8 when an image is recorded on the recording sheet P. In the second modified embodiment, (1) when the nozzles 10 belonging to the nozzle group G2 are set as the use nozzles (S107), and (2) when the controller 80 has determined in S109 that the discharge-defective nozzle is included in the nozzles 10 belonging to the nozzle group G2, the controller 80 determines in S110 whether the discharge-defective nozzle is included in the nozzles 10 belonging to the nozzle group G4. When no discharge-defective nozzle is included in the nozzles 10 belonging to the nozzle group G4 (S110: YES), the controller 80 changes the use nozzles to the nozzles 10 belonging to the nozzle group G4 (S111).

In the second modified embodiment, (1) when the controller 80 has set the nozzles 10 belonging to the nozzle group G1 as the use nozzles (S108), and (2) when the controller 80 has determined in S109 that the discharge-defective nozzle is included in the nozzles 10 belonging to the nozzle group G1, the controller 80 determines in S110 whether the discharge-defective nozzle is included in the nozzles 10 belonging to the nozzle group G3. When no discharge-defective nozzle is included in the nozzles 10 belonging to the nozzle group 3 (S110: YES), the controller 80 changes the use nozzles to the nozzles 10 belonging to the nozzle group G3.

In the second modified embodiment, when the recording sheet P is the regular sheet, and when the nozzles 10 belonging to the nozzle group G2 are set as the use nozzles (S108), the nozzles 10 belonging to the nozzle group G4 correspond to the second nozzle of the present disclosure. When the recording sheet P is the gloss sheet, and when the nozzles 10 belonging to the nozzle group G1 are set as the use nozzles (S107), the nozzles 10 belonging to the nozzle group G3 correspond to the second nozzle of the present disclosure.

For example, as described in the above embodiment, the controller 80 sets, in S107 or S108, the nozzles 10 that are likely to stable in the distance between themselves and the recording sheet P as the use nozzles depending on the type of the recording sheet P. When the controller 80 changes, in S111, the use nozzles from the nozzles 10 set in S107 or S108 to other nozzles, the distance between the nozzles 10 and the recording sheet P easily varies, which may be likely to shift the landing positions of ink in the recording pass. In view of the above, in the second modified embodiment, the controller 80 makes the number of the use nozzles after the change in S111 smaller than the number of the nozzles set as the use nozzles in S107 or S108. This increases the number of execution times of the recording pass required for the image recording on the recording sheet P, but it is possible to inhibit the shift of ink landing positions in each recording pass as much as possible.

In the above embodiment, the example in which image recoding is performed on the recording sheet P by discharging all the four color inks from the nozzles 10 belonging to the four nozzle rows 9 is explained. The present disclosure, however, is not limited to such an aspect.

For example, in the third modified embodiment, a printer can perform image recording by selecting the recording mode from among the high speed recording mode similar to the above embodiment, the high image quality recording mode similar to the above embodiment, and a photo recording mode. The high speed image recording mode and the high image quality recording mode correspond to a discharge mode using both portions according to the present disclosure. The photo recording mode corresponds to a discharge mode using one portion according to the present disclosure. The image recording is performed by discharging the inks of the four colors both in the high speed recording mode and the high image quality recording mode. In the photo recording mode, the image recording is performed by discharging color inks (yellow, cyan, and magenta) from the nozzles 10 belonging to the left-side three nozzle rows 9, and the black ink is not discharged from the nozzles 10 belonging to the rightmost nozzle row 9.

In the following, the nozzles 10 from which the black ink is discharged may be referred to as black nozzles 10K and the nozzles 10 from which the color inks are discharged may be referred to as color nozzles 10C. Further, in the third modified embodiment, the rightmost nozzle row 9 formed by the black nozzles 10K arranged in the conveyance direction corresponds to a black nozzle row of the present disclosure. The left-right three nozzle rows 9 formed by the color nozzles 10C arranged in the conveyance direction correspond to color nozzle rows of the present disclosure.

Figure 12A:
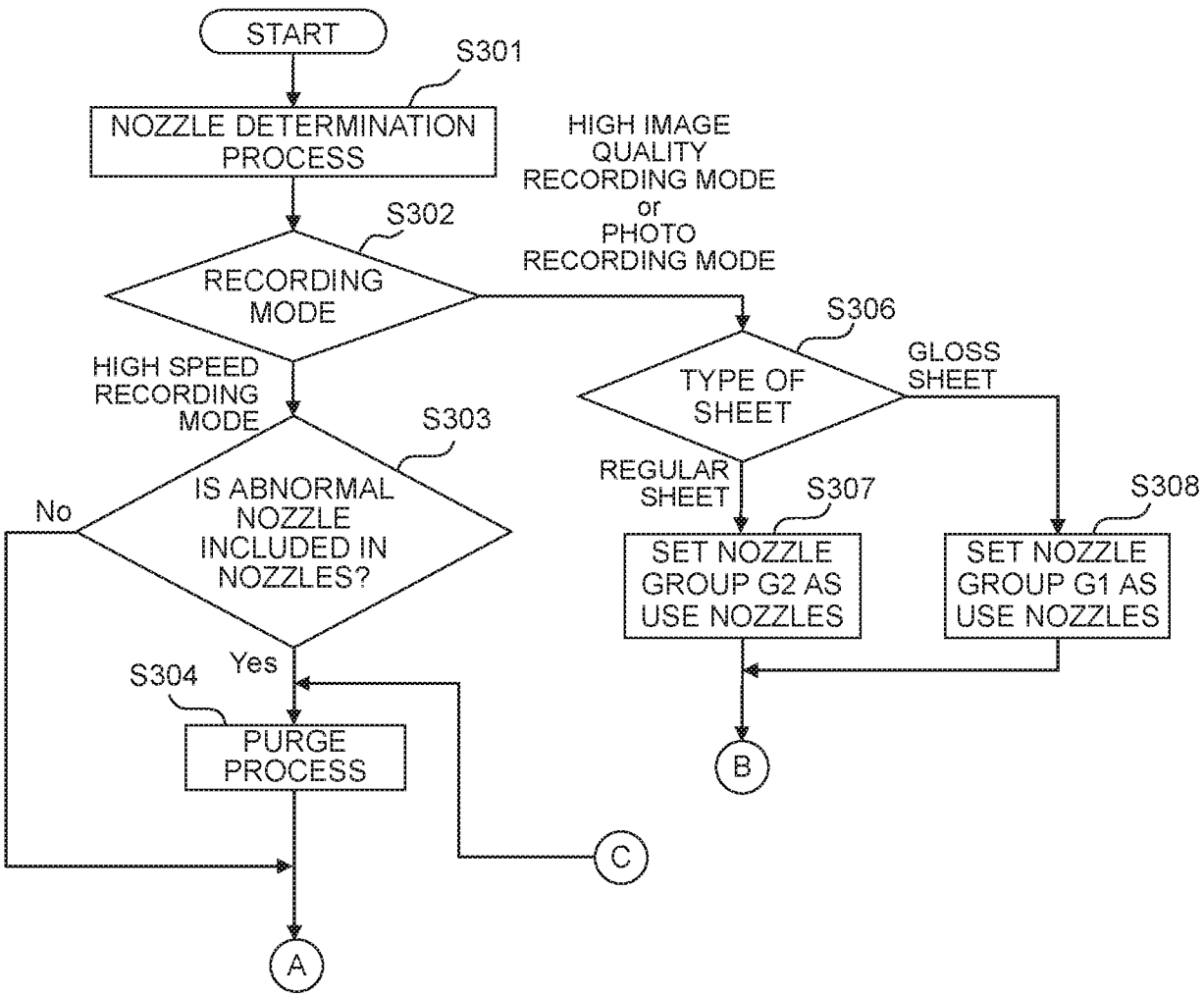
FIGS. 12A and 12B depict a flowchart indicating a series of processes in recording according to the third modified embodiment.
Figure 12B:
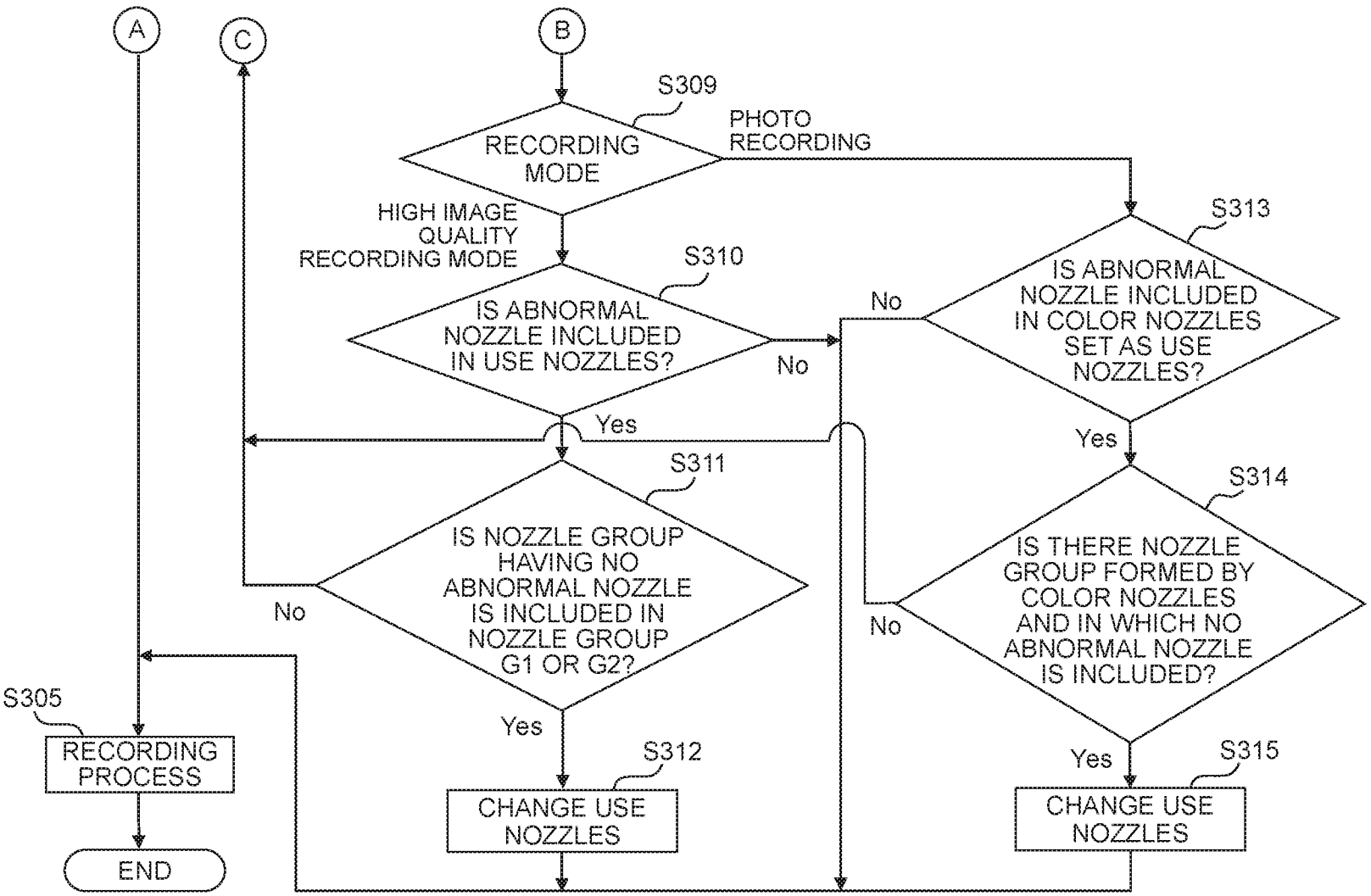

In the third modified embodiment, the controller 80 performs processes in accordance with the flowchart of FIGS. 12A and 12B when a printer records an image on the recording sheet P. More specifically, the controller 80 first performs the nozzle determination process (S301) similar to S101 in the above embodiment. Subsequently, the controller 80 determines the recording mode (S302). Specifically, the controller 80 determines which one of the high speed recording mode, the high image quality recording mode, and the photo recording mode is selected or used.

When the high speed recording mode is used (S302: high speed recording mode), the controller 80 performs the processes of S303 to S305 similar to the processes of S103 to S105 in the above embodiment. When the high image quality mode or the photo recording mode is used (S302: high image quality recording mode or photo recording mode), the controller 80 sets the nozzles 10 belonging to one of the nozzle groups G1 and G2 as the use nozzles through the processes of S306 to S308 similar to the processes of S106 to S108 in the above embodiment.

In the third modified embodiment, when recording is performed using the high image quality recording mode, the black nozzles 10K belonging to the nozzle group G2 when the recording sheet P is the regular sheet and the black nozzles 10K belonging to the nozzle group G1 when the recording sheet P is the gloss paper correspond to a plurality of first black nozzles of the present disclosure.

In the third modified embodiment, both when recording is performed using the high image quality recording mode and when recording is performed using the photo recording mode, the color nozzles 10C belonging to the nozzle group G2 when the recording sheet P is the regular sheet and the color nozzles 10C belonging to the nozzle group G1 when the recording sheet P is the gloss paper correspond to a plurality of first color nozzles of the present disclosure.

Subsequently, when the high image quality recording mode is used (S309: high image quality recording mode), the controller 80 performs the processes of S310 to S312 similar to the processes of S109 to S111 in the above embodiment.

Accordingly, in the third modified embodiment, the black nozzles 10K and the color nozzles 10C belonging to one of the nozzle groups G1 and G2 are set as the use nozzles depending on the type of the recording sheet P (S307 or S308). The black nozzles 10K and the color nozzles 10C set as the use nozzles in S307 or S308 have the same positions in the conveyance direction.

Further, (1) when the discharge-defective nozzle is included in any of the black nozzles 10K and the color nozzles 10C belonging to the one of the nozzle groups G1 and G2 (S310), and (2) when no discharge-defective nozzle is included in the black nozzles 10K and the color nozzles 10C belonging to the other nozzle group (S311: YES), the controller 80 changes the use nozzles to the black nozzles 10K and the color nozzles 10C belonging to the other nozzle group (S312). The black nozzles 10K and the color nozzles 10C set as the use nozzles after the change in S312 have the same positions in the conveyance direction.

When the photo recording mode is used (S309: photo recording mode), the controller 80 determines whether the discharge-defective nozzle is included in the color nozzles 10C set as the use nozzles (S313). When the discharge-defective nozzle is not included in the color nozzles 10C (S313: NO), the controller 80 proceeds to the recording process of S305 independently of the determination result of whether the discharge-defective nozzle is included in the black nozzles 10K.

When the discharge-defective nozzle is included in the color nozzles 10C set as the use nozzles (S313: YES), the controller 80 determines whether there is a nozzle group formed by the color nozzles 10C and in which no discharge-defective nozzle is included (S314). Specifically, when the nozzles 10 belonging to the nozzle group G2 are set as the use nozzles (S307), the controller 80 determines whether the discharge-defective nozzle is included in the color nozzles 10C belonging to the nozzle group G1. When the nozzles 10 belonging to the nozzle group G1 are set as the use nozzles (S308), the controller 80 determines whether the discharge-defective nozzle is included in the color nozzles 10C belonging to the nozzle group G2.

When there is the nozzle group formed by the color nozzles 10C and in which no discharge-defective nozzle is included (S314: YES), the controller 80 changes the use nozzles from the nozzles 10 currently set to the nozzles 10 belonging to the nozzle group formed by the color nozzles 10C and in which no discharge-defective nozzle is included (S315). Then, the controller 80 proceeds to the recording process of S305. When there is no nozzle group formed by the color nozzles 10C and in which no discharge-defective nozzle is included (S314: NO), the controller 80 performs the purge process of S304 and performs the recording process of S305.

In the third modified embodiment, when recording is performed by the high image quality recording mode, the black nozzles 10K belonging to the nozzle group G1 when the recording sheet P is the regular sheet and the black nozzles 10K belonging to the nozzle group G2 when the recording sheet P is the gloss sheet correspond to a plurality of second black nozzles of the present disclosure.

In the third modified embodiment, both when recording is performed using the high image quality recording mode and when recording is performed using the photo recording mode, the color nozzles 10C belonging to the nozzle group G2 when the recording sheet P is the regular sheet and the color nozzles 10C belonging to the nozzle group G1 when the recording sheet P is the gloss sheet correspond to the plurality of second black nozzles of the present disclosure.

In the third modified embodiment, (1) when recording is performed using the high image quality recording mode in which inks are discharged both from part of the black nozzles 10K and from part of the color nozzles 10C, and (2) when the discharge-defective nozzle is not included in the nozzles 10 belonging to one of the nozzle groups G1 and G2 depending on the type of the recording sheet P, recording is performed by setting the nozzles 10 belonging to the one of the nozzle groups G1 and G2 as the use nozzles. Further, (1) when the discharge-defective nozzle is included in the nozzles 10 belonging to the one of the nozzle groups G1 and G2 and (2) when the discharge-defective nozzle is not included in the nozzles 10 belonging to the other nozzle group, recording is performed by setting the nozzles 10 belonging to the other nozzle group as the use nozzles. Accordingly, inks are discharged from the black nozzles including no discharge-defective nozzle and the color nozzles including no discharge-defective nozzle on the recording sheet P.

On the other hand, (1) when recording is performed by the photo recording mode in which ink(s) is/are discharged from part of the color nozzles 10C and ink is not discharged from the black nozzles 10K, and (2) when the discharge-defective nozzle is not included in the color nozzles 10C belonging to one of the nozzle groups G1 and G2 depending on the type of the recording sheet P, recording is performed by setting the color nozzles 10C belonging to the one of the nozzle groups G1 and G2 as the use nozzles independently of whether the discharge-defective nozzle is included in the black nozzles 10 belonging to the one of the nozzle groups G1 and G2. Further, (1) when the discharge-defective nozzle is included in the color nozzles 10C belonging to the one of the nozzle groups G1 and G2 and (2) when the discharge-defective nozzle is not included in the color nozzles 10C belonging to the other nozzle group, recording is performed by setting the color nozzles 10C belonging to the other nozzle group as the use nozzles independently of whether the discharge-defective nozzle is included in the black nozzles 10K belonging to the other nozzle group. Accordingly, ink(s) is/are discharged from the color nozzles 10C including no discharge-defective nozzle on the recording sheet P.

In the above embodiment(s), the ink-jet head 4 includes multiple black nozzles from which the black ink is discharged and multiple color nozzles 10 from which the color inks are discharged. When the high image quality recording mode in which recording is performed by discharging inks both from part of the black nozzles and from part of the color nozzles is used, the black nozzles and the color nozzles having the same positions in the conveyance direction are set as the use nozzles. The present disclosure, however, is not limited to such an aspect. For example, the ink-jet head may include one nozzle row formed by multiple nozzles arranged in the conveyance direction.

In the above embodiment, when image recording is performed using the high image quality recording mode, an image is recorded by using part of the nozzles 10 belonging to each nozzle row and arranged continuously in the conveyance direction. The present disclosure, however, is not limited to such an aspect. For example, image recording may be performed by using every other nozzle included in the nozzles 10 belonging to each nozzle row 9. Namely, at least part of the use nozzles may not be arranged continuously in the conveyance direction, and nozzle(s) not to be used may be arranged therebetween.

In the above embodiment, the printer can perform image recording on the recording sheet P by selecting either of the high speed recording mode in which all the nozzles 10 belonging to each nozzle row 9 are used, and the high image quality recording mode in which only part of the nozzles 10 belonging to each nozzle row 9 are used. The present disclosure, however, is not limited to such an aspect. For example, the printer may perform image recording on the recording sheet P by selecting any of multiple kinds of recording modes in which only part of the nozzles belonging to each nozzle row 9 are used. Or, the printer may be capable of performing image recording on the recording sheet P by using only one kind of recording mode in which part of the nozzles belonging to each nozzle row 9 are used.

In the above embodiment, the controller 80 temporarily sets the use nozzles. When the discharge-defective nozzle is included in the use nozzles set temporarily, the controller 80 changes the use nozzles. The present disclosure, however, is not limited to such an aspect. For example, the controller 80 may set the use nozzles not to include the discharge-defective nozzle based on the result of the nozzle determination process of S101.

In the above embodiment, the ink-jet head is a so-called serial head that moves in the scanning direction together with the carriage. The present disclosure, however, is not limited to such an aspect. The ink-jet head may be a so-called line head that extends over an entire length in the scanning direction of the recording sheet P. In that case, the printer may include, for example, a guide for adjusting a position in the scanning direction of the recording sheet P depending on the size in the scanning direction of the recording sheet P. When an image is recorded by discharging ink from only part of the nozzles of the line head, the part of the nozzles of the line head are set as the use nozzles based on the position in the scanning direction of the recording sheet P subjected to the position adjustment by use of the guide. When the discharge-defective nozzle is included in the use nozzles, the use nozzles are changed so as not to include the discharge-defective nozzle. The position in the scanning direction of the recording sheet P is changed by moving the guide in accordance with the change in the use nozzles. Instead of changing the position in the scanning direction of the recording sheet P by use of the guide, a line head movable in the scanning direction may be used. In that case, the position in the scanning direction may be changed by moving the line head.

In the above embodiment, inks in the ink-jet head 4 are discharged from the nozzles 10 through the suction purge. The present disclosure, however, is not limited to such an aspect. For example, a pressurization pump may be provided in each tube 13 connecting the subtank 3 and each ink cartridge 15. Or, the printer may include a pressurization pump connected to the ink cartridges. In that configuration, a so-called pressurizing purge may be performed in which inks in the ink-jet head 4 are discharged from the nozzles 10 by driving the pressurization pump to pressurize the inks in the ink-jet head 4 with the nozzles 10 being covered with the cap 61. In that case, a combination of the cap 61 and the pressurization pump corresponds to a discharge mechanism of the present disclosure.

The purge may include the suction by the suction pump 62 and the pressurization by the pressurization pump. In that case, a combination of the maintenance unit 8 and the pressurization pump corresponds to the discharge mechanism of the present disclosure.

Alternatively, flushing (a discharge operation of the present disclosure) in which ink is discharged from the nozzle 10 by driving the driving element 50 corresponding to the discharge-defective nozzle may be performed instead of the purge. In that case, the driving element 50 corresponds to the discharge mechanism of the present disclosure.

In the above embodiment, whether the nozzle 10 is the discharge-defective nozzle is determined by using the voltage value of the electrode 66 when ink is discharged from the nozzle 10 to the electrode 66. The present disclosure, however, is not limited thereto.

For example, a detection electrode extending in the up-down direction may be provided. Whether the nozzle 10 is the discharge-defective nozzle may be determined using a voltage value of the detection electrode when ink is discharged from the nozzle 10 to pass through an area facing the detection electrode. Or, an optical sensor that detects ink discharged from the nozzle 10 may be provided, and whether the nozzle 10 is the discharge-defective nozzle may be determined based on a detection result of the optical sensor.

Or, for example, slimier to the description of Japanese Patent No. 4,929,699, a voltage detection circuit (a signal output circuit of the present disclosure) that detects a change in voltage when ink is discharged from the nozzle is connected to a plate on which the nozzles of the ink-jet head are formed, and a signal depending on whether the nozzle 10 is the discharge-defective nozzle may be output from the voltage detection circuit to the controller 80. The disclosure of Japanese Patent No. 4,929,699 is incorporated herein by reference in its entirety.

Or, for example, slimier to the description of Japanese Patent No. 6,231,759, a temperature detection element may be provided in a substrate of the ink-jet head. In that configuration, a heater may be driven by applying a first application voltage to discharge ink, and the heater may be driven by applying a second application voltage not to discharge ink. Then, whether ink is discharged properly or normally may be determined based on a temperature change detected by the temperature detection element after the second application voltage is applied until a predefined time elapses. The disclosure of Japanese Patent No. 6,231,759 is incorporated herein by reference in its entirety.

In the above embodiment, when ink is not discharged from a certain nozzle 10 included in the nozzles 10, the certain nozzle 10 is determined as the discharge-defective nozzle. The present disclosure, however, is not limited to such an aspect. For example, the controller 80 may determine whether the nozzle 10 is the discharge-defective nozzle based on whether the flying speed of ink discharged from the nozzle 10 is within a predefined speed, whether ink discharged from the nozzle 10 has landed on a predefined landing position, whether a desired amount of ink is discharged from the nozzle 10, or the like.

In the above embodiment, the controller 80 determines based on the signal from the determination circuit 68 whether each of the nozzles 10 is discharge-defective nozzle. The present disclosure, however, is not limited to such an aspect. For example, the controller 80 may determine based on the signal from the determination circuit 68 whether part of the nozzles 10 are the discharge-defective nozzles, and may infer based on the determination result of the part of the nozzles 10 whether the remaining nozzles 10 are the discharge-defective nozzles.

In the above embodiment, ink is discharged from the nozzle 10 when the driving element 50 applies pressure to the ink in the pressure chamber 40. The present disclosure, however, is not limited to such an aspect. For example, ink may be discharged from the nozzle by heating ink and generating bubbles in the ink channel(s).

In the above embodiment, the recording sheet P is conveyed by the conveyance roller pairs 6 and 7. The present disclosure, however, is not limited to such an aspect. For example, the recording sheet P may be conveyed by a conveyance belt. In this case, the conveyance belt corresponds to the conveyer of the present disclosure. Or, the medium may be conveyed by providing a movable table by use of a ball screw or the like and moving the table with the medium placed on the table. In this case, the table that is movable through the ball screw or the like corresponds to the conveyer of the present disclosure.

The examples in which the present disclosure is applied to the printer that discharges ink from nozzles to perform recording on a recording sheet P are explained above. The present disclosure, however, is not limited to such an aspect. The present disclosure can be applied to a printer that performs image recording on any other recording medium than the recording sheet, such as a T-shirt, a sheet for out-of-home advertising, a case of a mobile terminal including a smartphone, cardboard, and a resin member. Further, the present disclosure is applicable to a liquid ejection apparatus ejecting any other liquid than ink, such as liquefied resin and liquefied metal.

What is claimed is:

1. A liquid ejection apparatus configured to eject a liquid on a medium, the apparatus comprising:

a liquid ejection head including a plurality of nozzles arranged in a predefined direction;

a signal output circuit configured to output a signal that varies depending on whether at least part of the plurality of nozzles includes a discharge-defective nozzle of which discharge performance is lower than a predefined discharge performance;

a discharge mechanism configured to perform a discharge operation in which the liquid in the liquid ejection head is discharged from the plurality of nozzles; and a controller configured to:

control the liquid ejection head to discharge the liquid on the medium by using a partial discharge mode in which the liquid is discharged from part of the plurality of nozzles;

perform determination, for at least one nozzle included in the plurality of nozzles based on the signal from the signal output circuit, as to whether the discharge-defective nozzle is included therein;

set, based on the signal from the signal output circuit, the part of the plurality of nozzles to exclude the discharge-defective nozzle in a case that the liquid is discharged from the liquid ejection head on the medium by using the partial discharge mode and the controller has determined that the discharge-defective nozzle is included in the plurality of nozzles;

control the liquid ejection head to discharge the liquid on the medium by selectively using either of the partial discharge mode or an entire discharge mode in which the liquid is discharged from all the plurality of nozzles;

in a case that the liquid is discharged from the liquid ejection head on the medium by using the entire discharge mode and that the controller has determined that the discharge-defective nozzle is included in the plurality of nozzles, control the liquid ejection head to discharge the liquid from the plurality of nozzles on the medium after the discharge operation of the discharge mechanism; and in the case that the liquid is discharged from the liquid ejection head on the medium by using the partial discharge mode and that the controller has determined that the discharge-defective nozzle is included in the plurality of nozzles, set the part of the plurality of nozzles not to include the discharge-defective nozzle, and control the liquid ejection head to discharge the liquid from the part of the plurality of nozzles on the medium without the discharge operation of the discharge mechanism.

2. The liquid ejection apparatus according to claim 1, wherein the controller is configured to perform the determination, for all the plurality of nozzles based on the signal from the signal output circuit, about whether the discharge-defective nozzle is included therein.

3. The liquid ejection apparatus according to claim 1, wherein the predefined discharge performance is one of a discharge performance as to whether an ink droplet of a predetermined size is discharged from a nozzle, a discharge performance as to whether the ink droplet is discharged at a predetermined speed, and a discharge performance as to whether the ink droplet is discharged in a predetermined direction.

4. The liquid ejection apparatus according to claim 1, wherein the partial discharge mode is a mode by which the liquid ejection head discharges the liquid from the part of the plurality of nozzles arranged continuously in the predefined direction.

5. The liquid ejection apparatus according to claim 4, further comprising a memory configured to memorize information of a plurality of nozzle groups each formed by the part of the plurality of nozzles arranged continuously in the predefined direction, wherein in the case that the liquid is discharged from the liquid ejection head on the medium by using the partial discharge mode and in a case that the controller has determined that the discharge-defective nozzle is excluded in a plurality of first nozzles included in the plurality of nozzle groups and included in a first nozzle group, the controller is configured to set the plurality of first nozzles as the part of the plurality of nozzles, in the case that the liquid is discharged from the liquid ejection head on the medium by using the partial discharge mode, in a case that the controller has determined that the discharge-defective nozzle is included in the plurality of first nozzles, and in a case that the controller has determined that the discharge-defective nozzle is excluded in a plurality of second nozzles included in the plurality of nozzle groups and belonging to a second nozzle group different from the first nozzle group, the controller is configured to set the plurality of second nozzles as the part of the plurality of nozzles.

6. The liquid ejection apparatus according to claim 4, wherein in the case that the liquid is discharged from the liquid ejection head on the medium by using the partial discharge mode and in a case that the controller has determined that the discharge-defective nozzle is not included in a plurality of first nozzles included in the plurality of nozzles and arranged continuously in the predefined direction, the controller is configured to set the plurality of first nozzles as the part of the plurality of nozzles, in the case that the liquid is discharged from the liquid ejection head on the medium by using the partial discharge mode and in a case that the controller has determined that the discharge-defective nozzle is included in the plurality of first nozzles, the controller is configured to set, as the part of the plurality of nozzles, one first nozzle that is included in the plurality of first nozzles and that is not the discharge-defective nozzle or part of the plurality of first nozzles that exclude the discharge-defective nozzle and that are arranged continuously in the predefined direction, and a second nozzle that is included in the plurality of nozzles, that is not the discharge-defective nozzle, and that is arranged continuously from the part of the plurality of first nozzles in the predefined direction.

7. The liquid ejection apparatus according to claim 5, further comprising a conveyer configured to convey the medium in a conveyance direction; and a carriage carrying the liquid ejection head and configured to move in a scanning direction orthogonal to the conveyance direction, wherein the plurality of nozzles are arranged in the conveyance direction.

8. The liquid ejection apparatus according to claim 7, wherein the conveyer includes a roller pair disposed downstream of the liquid ejection head in the conveyance direction and configured to convey the medium having a sheet shaped in the conveyance direction while nipping the medium, and the plurality of first nozzles are included in the plurality of nozzles and are disposed at a downstream side of the plurality of nozzles in the conveyance direction.

9. The liquid ejection apparatus according to claim 7, wherein the conveyer is configured to selectively convey, as the medium, either of a first sheet or a second sheet into which the liquid landing thereon is less likely to permeate compared to the first sheet, the conveyer includes:

a roller pair disposed downstream of the liquid ejection head in the conveyance direction and configured to nip and convey the sheet in the conveyance direction, and a holding member disposed upstream of the liquid ejection head in the conveyance direction and configured to hold a facing surface of the sheet that is capable of facing the liquid ejection head, in a case that the sheet is the first sheet, the plurality of first nozzles are nozzles included in the plurality of nozzles and disposed at a downstream side of the plurality of nozzles in the conveyance direction, and in a case that the sheet is the second sheet, the plurality of first nozzles are nozzles included in the plurality of nozzles and disposed at an upstream side of the plurality of nozzles in the conveyance direction.

10. The liquid ejection apparatus according to claim 7, wherein in the case that the controller has determined that the discharge-defective nozzle is included in the plurality of first nozzles, the number of the nozzles set as the part of the plurality of nozzles is smaller than the number of the plurality of first nozzles.

11. The liquid ejection apparatus according to claim 5, wherein the liquid ejection head includes a black nozzle row and a color nozzle row, the black nozzle row being formed by a plurality of black nozzles arranged in the predefined direction and from which a black ink is discharged, the color nozzle row being formed by a plurality of color nozzles arranged in the predefined direction, from which a color ink is discharged, and being positioned adjacent to the black nozzle row in a direction orthogonal to the predefined direction, the controller is configured to control the liquid ejection head to discharge the liquid on the medium by using, as the partial discharge mode, a discharge mode using both portions in which ink is discharged both from part of the plurality of black nozzles and from part of the plurality of color nozzles having a position in the predefined direction identical to that of the part of the plurality of black nozzles, in a case that the liquid is discharged from the liquid ejection head on the medium by using the discharge mode using both portions, in a case that the controller has determined that the discharge-defective nozzle is excluded in a plurality of first black nozzles included in the plurality of black nozzles arranged continuously in the predefined direction, and in a case that the controller has determined that the discharge-defective nozzle is excluded in a plurality of first color nozzles included in the plurality of color nozzles and having positions in the predefined direction identical to those of the plurality of first black nozzles, the controller is configured to set the plurality of first black nozzles as the part of the plurality of black nozzles, and set the plurality of first color nozzles as the part of the plurality of color nozzles, and in a case that the liquid is discharged from the liquid ejection head on the medium by using the discharge mode using both portions, and in a case that the controller has determined that the discharge-defective nozzle is included in at least any of the plurality of first black nozzles and the plurality of first color nozzles, the controller is configured to set, as the part of the plurality of black nozzles, a plurality of second black nozzles included in the plurality of black nozzles, arranged continuously in the predefined direction, not including the discharge-defective nozzle, and corresponding to a plurality of color nozzles that are included in the plurality of color nozzles and that exclude the discharge-defective nozzle and of which positions in the predefined direction are identical to those of the plurality of second black nozzles, and the controller is configured to set, as the part of the plurality of color nozzles, a plurality of second color nozzles included in the plurality of color nozzles and having positions in the predefined direction identical to those of the plurality of second black nozzles.

12. The liquid ejection apparatus according to claim 11, wherein the controller is configured to control the liquid ejection head to discharge the liquid on the medium by selectively using, as the partial discharge mode, either of the discharge mode using both portions or a discharge mode using one portion in which the color ink is discharged from the part of the plurality of color nozzles and the black ink is not discharged from the plurality of black nozzles, in a case that the liquid is discharged from the liquid ejection head on the medium by using the discharge mode using one portion, in the case that the controller has determined that the discharge-defective nozzle is included in the plurality of first black nozzles, and in the case that the controller has determined that the discharge-defective nozzle is excluded in the plurality of first color nozzles, the controller is configured to set the plurality of first color nozzles as the part of the plurality of color nozzles.

* * * * *